US005627126A

United States Patent [19]

Amano et al.

[11] Patent Number: 5,627,126

[45] Date of Patent: May 6, 1997

[54] REVERSIBLE THERMOSENSITIVE RECORDING MEDIUM AND METHOD OF PRODUCING THE SAME

[75] Inventors: Tetsuya Amano, Numazu; Yoshihiko Hotta, Mishima; Makoto Kawaguchi, Shizuoka-ken, all of Japan

[73] Assignee: Ricoh Company, Ltd., Tokyo, Japan

[21] Appl. No.: 267,918

[22] Filed: Jul. 6, 1994

[30] Foreign Application Priority Data

Jul. 6, 1993 [JP] Japan ..... 5-191954
Nov. 8, 1993 [JP] Japan ..... 5-302416

[51] Int. Cl.[6] ..... B41M 5/40

[52] U.S. Cl. ..... 503/226; 427/150; 503/201; 503/217

[58] Field of Search ..... 503/201, 217, 503/226

[56] References Cited

U.S. PATENT DOCUMENTS 5,108,980 4/1992 Hotta et al. .
5,116,803 5/1992 Hotta et al. ..... 503/208
5,158,924 10/1992 Konagaya et al. .
5,219,820 6/1993 Morohoshi et al. .
5,278,128 1/1994 Hotta et al. ..... 503/207
5,283,220 2/1994 Kawaguchi et al. .
5,298,476 3/1994 Hotta et al. ..... 503/201
5,308,823 5/1994 Hotta et al. ..... 503/209
5,310,718 5/1994 Amano et al. .

FOREIGN PATENT DOCUMENTS 0014826 9/1980 European Pat. Off. .
0302374 2/1989 European Pat. Off. .
0543264 5/1993 European Pat. Off. .
2173574 9/1973 France .
3-227688 10/1991 Japan ..... 503/201

*Primary Examiner*—B. Hamilton Hess
*Attorney, Agent, or Firm*—Oblon, Spivak, McClelland, Maier & Neustadt, P.C.

[57] ABSTRACT

A reversible thermosensitive recording medium is composed of a support and a reversible thermosensitive recording layer whose transparency or color reversibly changes by the application of heat thereto formed on the support. The reversible thermosensitive recording layer has a thermal pressure level difference of 40% or less, land a thermal pressure level difference change ratio of 70% or less.

34 Claims, 12 Drawing Sheets

REVERSIBLE THERMOSENSITIVE RECORDING MEDIUM AND METHOD OF PRODUCING THE SAME

BACKGROUND OF THE INVENTION

1. Field of the Invention

The present invention relates to a reversible thermosensitive recording medium, more particularly to a reversible thermosensitive recording medium comprising a reversible thermosensitive recording layer, with the transparency or color thereof being reversibly changeable depending upon the temperature thereof, which is capable of recording information therein and erasing recording information therefrom by utilizing the reversibly changeable transparency or color of the reversible thermosensitive recording layer. The present invention also relates to a method of producing such a reversible thermosensitive recording medium.

2. Discussion of Background

Recently, reversible thermosensitive recording media, which are capable of temporarily forming images or recording information therein and also capable of deleting formed images or recorded information therefrom when such formed images or recorded information becomes unnecessary, have attracted attention.

Japanese Laid-Open Patent Applications 54-119377 and 55-154198 disclose representative examples of such a reversible thermosensitive recording medium, which comprises an organic low-molecular weight material such as a higher fatty acid, which is dispersed in a matrix resin such as a vinyl chloride—vinyl acetate copolymer having a low glass transition temperature (Tg) in the range of 50°–60° C. to less than 80° C.

Such a reversible thermosensitive recording medium, however, has the shortcomings that the reversible thermosensitive recording layer thereof is deformed and the density and contrast of the formed images are lowered during repeated image formation and erasure by use of a heating element such as a thermal head.

In order to eliminate the above-mentioned shortcomings of the conventional reversible thermosensitive recording medium, and also in order to increase the durability of the reversible thermosensitive recording medium during repeated image formation and erasure thereof by use of a thermal head or the like, the inventors of the present invention have proposed in Japanese Laid-Open Patent Applications 5-169809 and 5-169810 that the average polymerization degree of a matrix resin for use in the reversible thermosensitive recording layer and the content of the vinyl chloride repeat unit contained therein be respectively limited to particular values, in particular, the average polymerization degree be increased to a particular value.

Furthermore, the inventors of the present invention have proposed to contain epoxy resin in the reversible thermosensitive recording layer and, in particular, to subject the reversible thermosensitive recording layer to thermosetting as disclosed in Japanese Laid-Open Patent Application 5-38872.

These proposals, however, have not achieved the desired effects sufficiently.

Furthermore, in Japanese Laid-Open Patent Application 5-085045, there is proposed a reversible thermosensitive recording medium comprising a reversible thermosensitive recording layer comprising as the matrix resin a thermosetting resin prepared from a hydroxyl-modified vinyl chloride—vinyl acetate copolymer and an isocyanate compound, in order to improve the heat resistance and mechanical strength of the reversible thermosensitive recording layer, thereby improving the repeated use durability of the reversible thermosensitive recording medium when a thermal head is used for image formation.

The thermosetting resin of the above-mentioned type, however, deteriorate with time with respect to the hardness thereof. More specifically, the hardness of the resin at the time of the formation of the reversible thermosensitive recording layer changes with time.

In particular, in the case of a reversible thermosensitive recording medium of the type in which an organic low-molecular-weight material is dispersed in a resin, the reversible thermosensitive recording layer thereof is usually transparent in a predetermined temperature range, and when the recording layer is heated to a temperature above the above-mentioned temperature range, the recording layer becomes milky white. Thus, image recording and image erasure are carried out in this reversible thermosensitive recording medium by utilizing the reversible changes from the transparent state to the milky white state and vice versa by selective heat application. When the above-mentioned reversible changes from the transparent state to the milky white state and vice versa are performed, it is preferable that the temperature range in which the recording layer maintains the transparent state stably (hereinafter referred to as the transparent temperature range) be broad to a certain extent.

However, in the case where the hardness of the resin employed in the reversible thermosensitive recording layer changes with time, the transparent temperature range is decreased with time, and it becomes impossible with time to erase images at the initially set erasure temperature. When this occurs, the setting of the erasure temperature becomes extremely complicated. In other words, the above-mentioned proposal has created the above-mentioned new problem. However, no proposal for solving this problem has been made yet.

Furthermore, recently the following problems have been reported with respect to the conventional reversible thermosensitive recording media:

Specifically, printing systems that perform printing on the conventional reversible thermosensitive recording media with the application of high printing energy thereto under the same conditions as those for a low-thermosensitive recording medium, for example, a thermal destruction type thermosensitive recording medium, is increasing in number. In this case, the energy for printing applied to the reversible thermosensitive recording media considerably exceeds the printing energy necessary for the formation of images on the reversible thermosensitive recording media, so that when thermal printing is performed on such reversible thermosensitive recording media by use of a printer for the above-mentioned thermal destruction type thermosensitive recording medium, the reversible thermosensitive recording media are caused to considerably deteriorate even by one printing operation, so that there is the tendency that sufficiently high image density and contrast for use in practice cannot be obtained thereafter.

There has not been proposed any countermeasure against the above-mentioned problems.

SUMMARY OF THE INVENTION

It is therefore a first object of the present invention to provide a reversible thermosensitive recording medium which is improved with respect to the stability of the transparent temperature range with time, and also with respect to the repeated use durability, for instance, when a thermal head or the like is used for image formation and erasure.

A second object of the present invention is to provide a reversible thermosensitive recording medium which is improved with respect to the repeated use durability under the application of high thermal energy, for instance, by a printer for thermal destruction type thermosensitive recording media.

These objects of the present invention can be achieved by a reversible thermosensitive recording medium comprising a support and a reversible thermosensitive recording layer whose transparency or color reversibly changes by the application of heat thereto, with the reversible thermosensitive recording layer having a thermal pressure level difference of 40% or less, and a thermal pressure level difference change ratio of 70% or less.

For the above-mentioned objects of the present invention, in the above reversible thermosensitive recording medium, the reversible thermosensitive recording layer may contain a resin which is crosslinked and having a gel percentage change ratio of 110% or less.

A third object of the present invention is to provide a method of producing the above-mentioned reversible thermosensitive recording medium.

This object of the present invention can be performed by crosslinking the resin by subjecting the resin to electron beam or ultraviolet light radiation a plurality of times.

BRIEF DESCRIPTION OF THE DRAWINGS

A more complete appreciation of the invention and many of the attendant advantages thereof will readily obtained as the same becomes better understood by reference to the following detailed description when considered in connection with the accompanying drawings, wherein:

FIG. 1(*b*) is a side view of the thermal pressure application apparatus shown in FIG. 1(*b*).

FIG. 2(*b*) is a side view of the thermal head shown in FIG. 2(*a*).

FIG. 8(*b*) schematically shows another thermosensitive recording image display apparatus of a pressure contact type.

FIG. 8(*c*) schematically shows a thermosensitive recording image display apparatus of a non-contact type.

FIG. 8(*d*) schematically shows a further thermosensitive recording image display apparatus of a pressure contact type.

FIG. 11(*b*) shows the surface roughness of the reversible thermosensitive recording medium No. 7, from which the protective layer was scraped off the recording layer, when the initial thermal pressure level difference thereof was measured.

FIG. 11(*c*) shows the surface roughness of the comparative reversible thermosensitive recording medium No. 3 prepared in Comparative Example 3, which was obtained when the initial thermal pressure level difference thereof was measured.

FIG. 11(*d*) shows the surface roughness of the comparative reversible thermosensitive recording medium No. 3, from which the protective layer was scraped off the recording layer, when the initial thermal pressure level difference thereof was measured in the above thermal pressure application test.

DESCRIPTION OF THE PREFERRED EMBODIMENTS

The reversible thermosensitive recording medium of the present invention comprises a support and a reversible thermosensitive recording layer whose transparency or color reversibly changes by the application of heat thereto, with the reversible thermosensitive recording layer having a thermal pressure level difference of 40% or less, and a thermal pressure level difference change ratio of 70% or less.

The above-mentioned thermal pressure level difference in the reversible thermosensitive recording medium of the present invention is defined as follows:

The thermal pressure level difference is a physical value indicating the hardness of a coated film when heated. The smaller the value, the harder the coated film. When the value of the thermal pressure level difference is 40% or less, the advantages of the present invention over the conventional reversible thermosensitive recording media, particularly the durability at the time of repeated image formation and erasure, for instance, by use of a thermal head, can be effectively obtained. It is considered that this is because when the value of the thermal pressure level difference is 40% or less, the force for restraining the particles of an organic low-molecular-weight compound from aggregating and becoming large, which may be otherwise caused by the mutual contact of the particles, is significantly increased, so that the deformation of the reversible thermosensitive recording layer is minimized even though heat and pressure are applied thereto, for instance, by a thermal head.

Figure 1A:
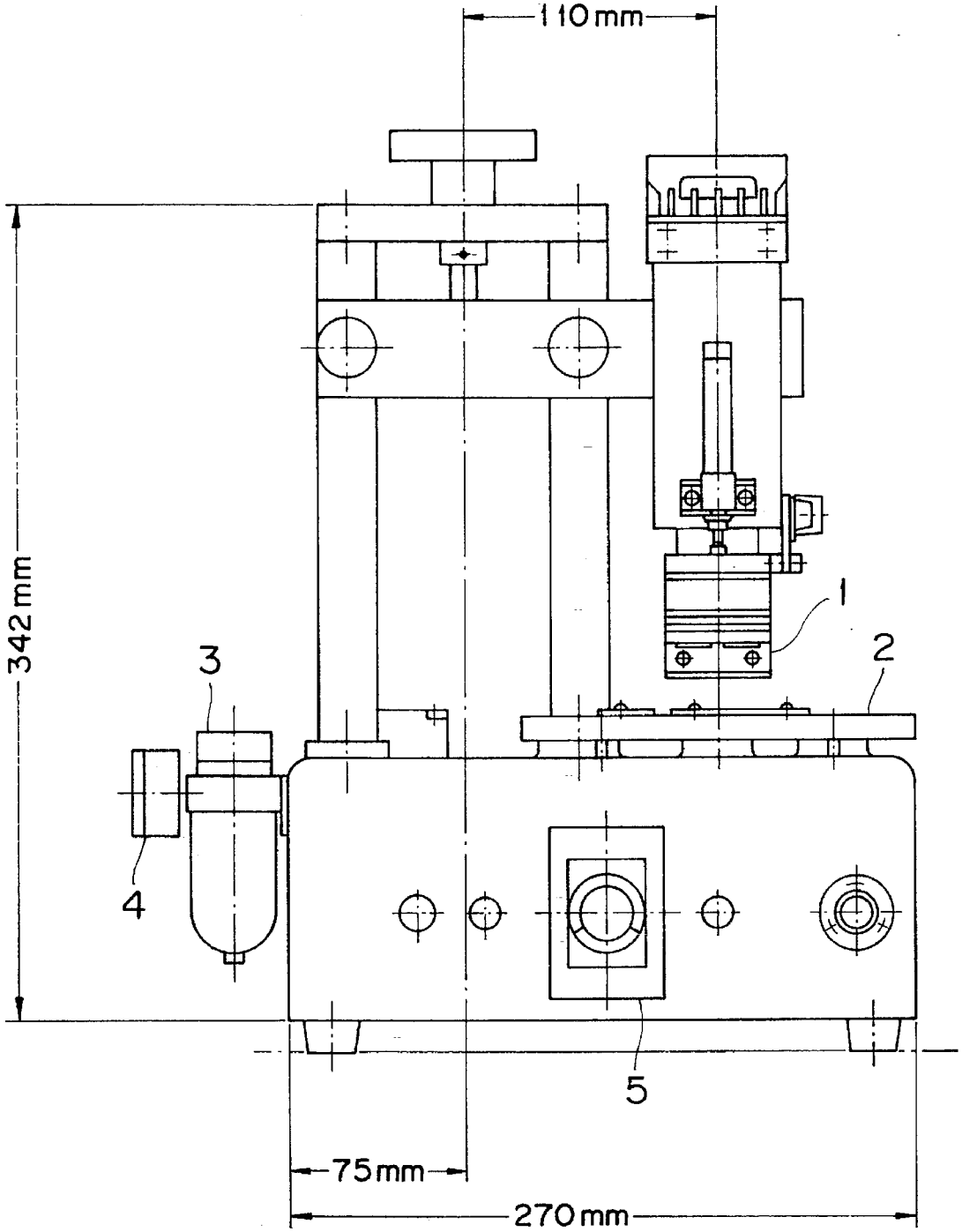
FIG. 1(*a*) is a front view of a thermal pressure application apparatus for the measurement of the thermal pressure level difference of a display portion in a reversible thermosensitive recording medium of the present invention.
Figure 1B:
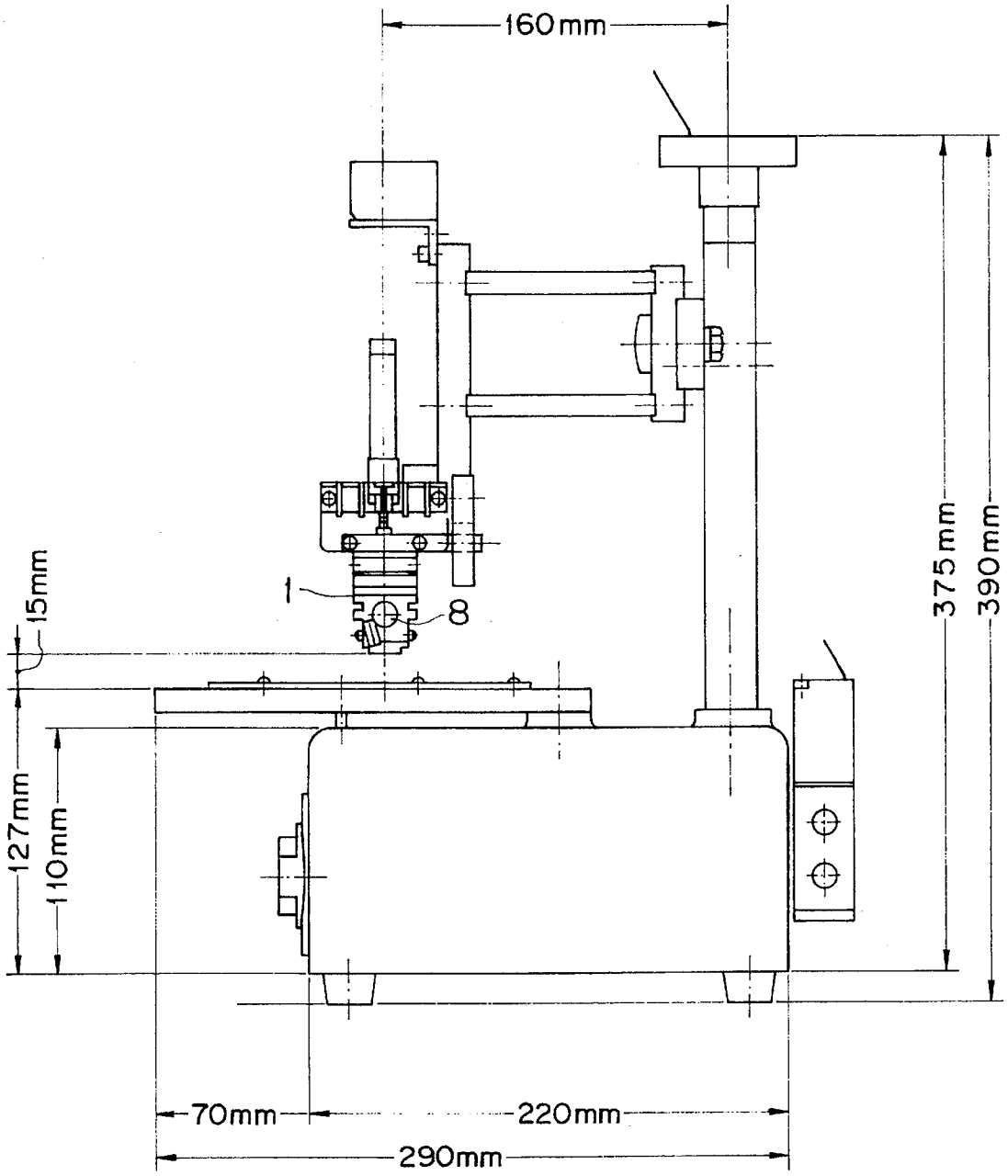

A thermal pressure application apparatus for the measurement of the thermal pressure level difference of a display portion in a reversible thermosensitive recording medium of the present invention are as shown in FIG. 1(*a*) and FIG. 1(*b*). More specifically, the thermal pressure application apparatus shown in FIGS. 1(*a*) and 1(*b*) is a desk-top hot-stamp air type TC film erasure test machine made by Unique Machinery Company, Ltd.

FIG. 1(*a*) is a schematic front view of the thermal pressure application apparatus, and FIG. 1(*b*) is a schematic side view of the thermal pressure application apparatus.

As shown in FIG. 1(*a*) and FIG. 1(*b*), the thermal pressure application apparatus comprises an air regulator 3 for pressure adjustment, a printing timer 5 for time adjustment, a temperature regulator (not shown) for temperature adjustment, a printing head 1 for thermal pressure printing, and a sample support 2 for supporting a test sample thereon.

Figure 2A:
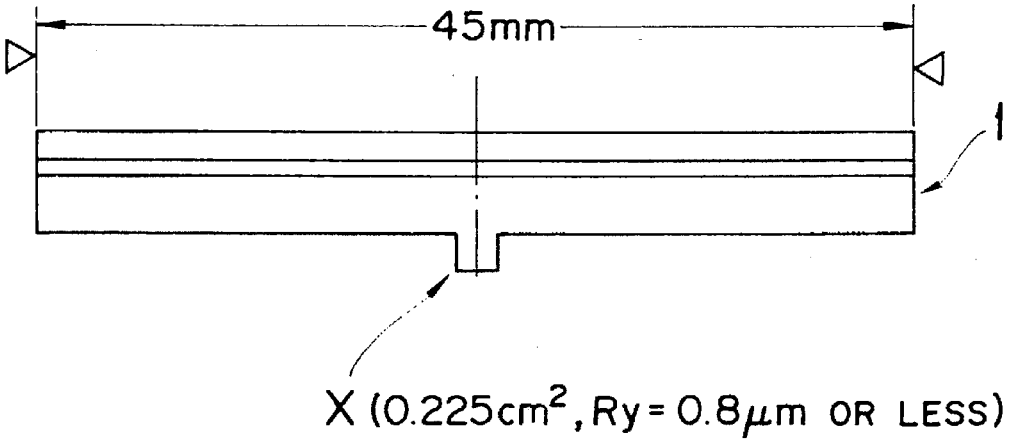
FIG. 2(*a*) is a front view of a thermal head for use in the present invention.
Figure 2B:
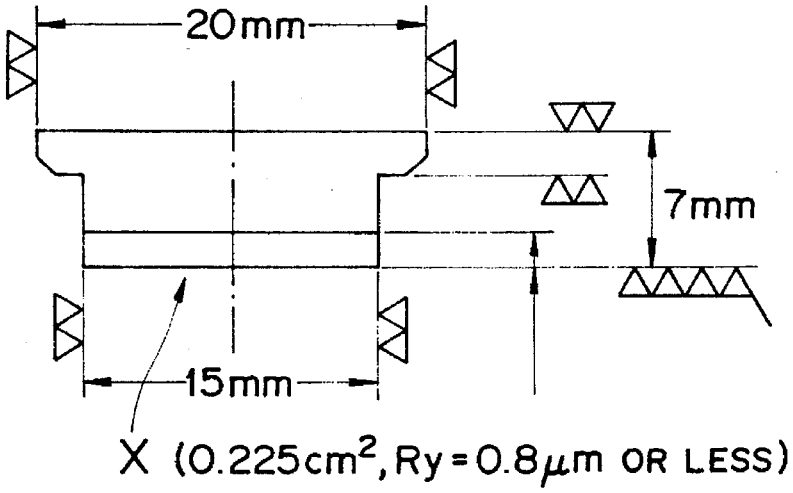

The printing head 1 is a printing head which is modified for the measurement of the thermal pressure level difference of a test sample of a reversible thermosensitive recording medium, more specifically a printing head shown in FIGS. 2(*a*) and 2(*b*).

As the material for the printing head 1, aluminum is employed. It is preferable that the surface roughness (Ry) of the projected portion X of the printing head 1 which comes into contact with the surface of the reversible thermosensitive recording layer be 0.8 μm or less in accordance with Japanese Industrial Standards (JIS) B0031-1982 and B0601-1994 as shown in FIG. 2(*a*) and FIG. 2(*b*). The cross-section area of the projected portion X, which comes into contact with the reversible thermosensitive recording layer is 0.225 $cm^2$ as shown in FIG. 2(*a*) and FIG. 2(*b*).

Figure 3:
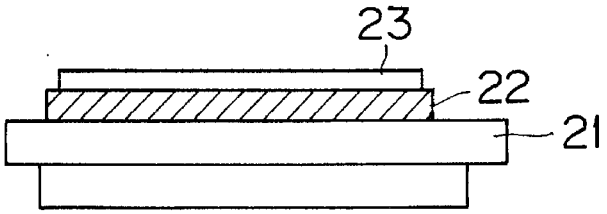
FIG. 3 is a perspective schematic illustration of a composite plate composed of an aluminum plate, a fluorine rubber layer on the aluminum plate, and a stainless steel plate formed on the fluorine rubber for placing a sample of a reversible thermosensitive recording medium to be tested.

On the sample support 2 shown in FIG. 1(*a*), there is provided a composite plate composed of an aluminum plate 21, a fluorine rubber layer 22 with a thickness of 1 mm provided on the aluminum plate 21, and a stainless steel plate 23 with a thickness of 1 mm and a spring hardness of HS65 provided on the fluorine rubber layer 22 as shown in FIG. 3, in order to prevent the pressure applied at thermal pressure application from being dispersed.

The conditions for the measurement of the thermal pressure level difference of the test sample by use of the thermal pressure application apparatus as shown in FIG. 1(*a*) and FIG. 1(*b*) are as follows:

The air regulator 3 shown in FIG. 1(*a*) is adjusted to obtain such a printing pressure that the air gauge pressure value in an air gauge 4 shown in FIG. 1(*a*) is 2.5 $kg/cm^2$. The printing timer 5 shown in FIG. 1(*a*) is then adjusted in such a manner that the printing time is set at 10 seconds. Furthermore, the temperature regulator 12 is adjusted in such a manner that the printing temperature is set at 130° C.

The printing temperature mentioned here is the temperature adjusted by a heater & temperature sensor 8 shown in FIG. 1(*b*), and is approximately the same as the temperature of the surface of the printing head 1.

A method of measuring the value of the thermal pressure level difference of a sample to which a thermal pressure is applied by the above-mentioned thermal pressure application apparatus will now be explained.

As the measurement apparatus, a two-dimensional roughness analyzer (Trademark "Surfcorder AY-41" made by Kosaka Laboratory Co., Ltd.), a recorder RA-60E, and Surfcorder SE30K are employed.

The measurement conditions for Surfcorder Se30K are set, for example, in such a manner that the vertical magnification (V) is 2,000, and the horizontal magnification (H) is 20.

The measurement conditions for Surfcoder AY-41 are set, for example, in such a manner that the standard length (L) is 5 mm, and the stylus scanning speed (DS) is 0.1 mm/sec. The measured results are recorded in charts by use of the recorder RA-60E. The value of the thermal pressure level difference (Dx) in the thermal pressure applied portion is read from the charts in which the measured results are recorded.

The above-mentioned measurement conditions are exemplary and can be changed as desired when necessary.

Figure 4:
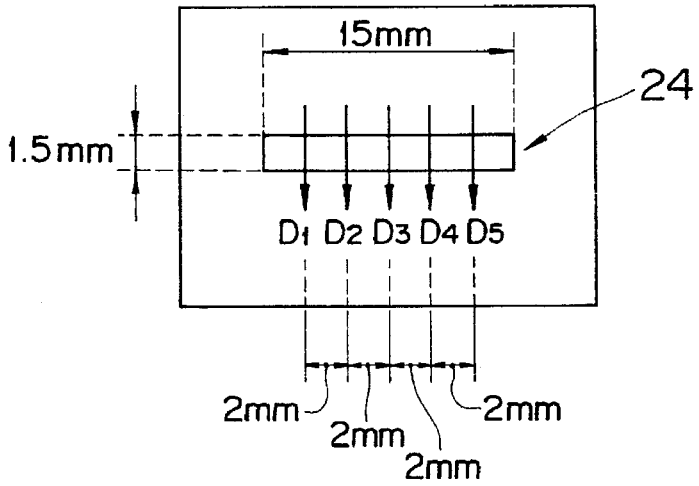
FIG. 4 is a schematic illustration of the portion of a sample for the measurement of the value of the thermal pressure level difference (Dx) thereof.

The measurement of the value of the thermal pressure level difference (Dx) is measured at 5 points, $D_1$ to $D_5$, with intervals of 2 mm therebetween in the width direction of the thermal pressure applied portion, as illustrated in FIG. 4, and the average value is obtained as the average thermal pressure level difference ($\overline{D}$), and the thermal pressure level difference (D) can be obtained from the average thermal pressure level difference ($\overline{D}$) and the thickness ($D_B$) of the reversible thermosensitive recording layer in accordance with the following formula:

$$D(\%)=(\overline{D}/D_B)\times 100\%$$

wherein D is the thermal pressure level difference (%), $\overline{D}$ is the average thermal pressure level difference (nm), and $D_B$ is the thickness (nm) of the reversible thermosensitive recording layer.

The above-mentioned thickness $D_B$ is the thickness of the reversible thermosensitive recording layer formed on the support and can be measured by inspecting the cross section of the reversible thermosensitive recording layer by a transmission electron microscope (TEM) or a scanning electron microscope (SEM).

The variation ratio of the thermal pressure level difference is a physical value indicating the degree of the variation with time of the thermal pressure level difference of a coated film when heated. The smaller the value, the stabler the coated film. When the variation ratio of the thermal pressure level difference is 70% or less, the advantages of the present invention over the conventional reversible thermosensitive recording media, particularly the wide transparent temperature range and the stability thereof, are conspicuously obtained. It is considered that this is because the thermal physical properties of the coated film are particularly improved when the variation ratio of the thermal pressure level difference in the above-mentioned range.

The variation ratio of the thermal pressure level difference can be determined in accordance with the following formula:

$$D_C(\%) = \left| \frac{D_I - D_D}{D_I} \right| \times 100$$

wherein $D_C$ is the variation ratio of the thermal pressure level difference (%), $D_I$ is the initial thermal pressure level difference (%), and $D_D$ is the thermal pressure level difference changed with time (%).

In the above, the initial thermal pressure level difference ($D_I$) is the value of the thermal pressure level difference of a sample image display portion measured for the first time after the preparation of the sample image display portion. This is not necessarily the value measured immediately after the preparation of the sample image display portion.

The thermal pressure level difference changed with time ($D_D$) is the value of the thermal pressure level difference of a sample image display portion which is prepared at the same time as that of the preparation of the sample image display portion for the measurement of the initial thermal pressure level difference ($D_I$) thereof and is then allowed to stand at 50° C. for 24 hours.

These values of the thermal pressure level difference are measured by the previously mentioned measurement method and then calculated in the same manner as mentioned previously.

In case these thermal pressure level differences cannot be measured under the same conditions (2.5 kg/cm$^2$, 130° C.) as mentioned previously, the pressure and temperature may be changed appropriately.

The measurement method for the thermal pressure level difference can be applied not only to the previously mentioned reversible thermosensitive recording medium including only the reversible thermosensitive recording layer, but also to the reversible thermosensitive recording medium including both the reversible thermosensitive recording layer and the protective layer therefor.

The reversible thermosensitive recording medium may be fabricated with such a layer structure that a thermosensitive recording layer and a magnetic recording layer comprising as the main component a magnetic material are provided on a support, and at least a lower portion of the thermosensitive recording layer or a portion of the support immediately below the thermosensitive recording layer is colored as disclosed in Japanese Utility Model Application 2-3876.

Furthermore, such a layer structure as disclosed in Japanese Laid-Open Patent Application 3-130188 that a magnetic recording layer, a light reflection layer, and a thermosensitive recording layer are successively overlaid on a support may also be applicable. In this case, the magnetic recording layer may be provided on the back side of the support opposite to the thermosensitive layer, or between the support and the thermosensitive recording layer. Other layer structures may also be employed.

The above-mentioned measurement of the thermal pressure level difference is applicable without any problems to the reversible thermosensitive recording media with any of the above-mentioned structures by the application of thermal pressure to the surface of the thermosensitive recording layer.

In the case where a protective layer is provided on the reversible thermosensitive recording layer which is formed on the support, it is necessary to expose the reversible thermosensitive recording layer by eliminating the protective layer therefrom. In this case, the thickness of the reversible thermosensitive recording layer and the thickness of the protective layer are measured by the cross section inspection thereof by using TEM or SEM, and the protective layer is scraped off.

Figure 5:
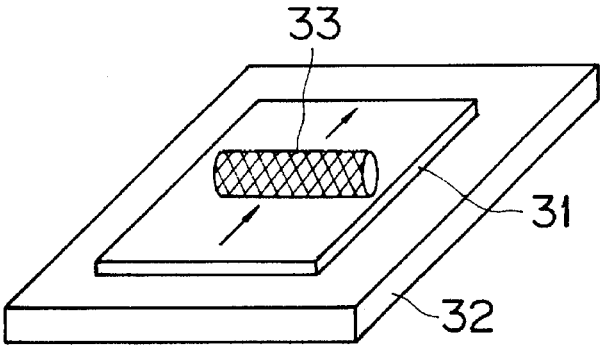
FIG. 5 is a schematic illustration of a method for scraping a protective layer of a reversible thermosensitive recording layer.
Figure 6A:
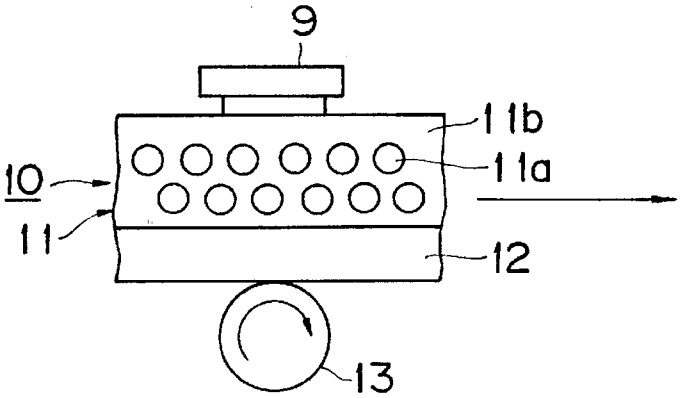
FIGS. 6(*a*) to 6(*d*) schematically show the changes of the state of the particles of an organic low-molecular-weight material which are dispersed within the reversible thermosensitive recording layer of a reversible thermosensitive recording medium in the course of image formation thereon by a thermal head.
Figure 6B:
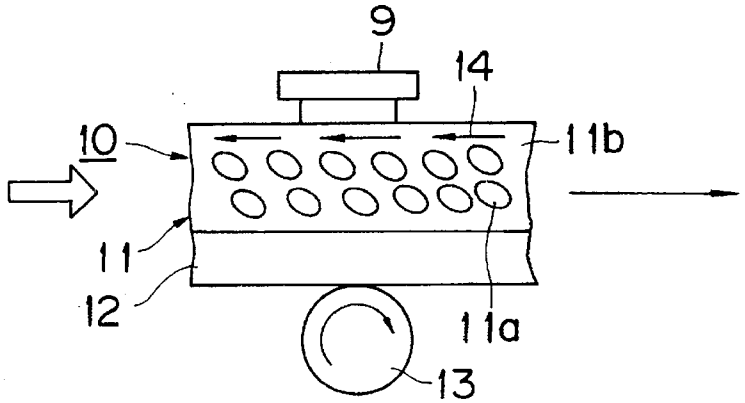
Figure 6C:
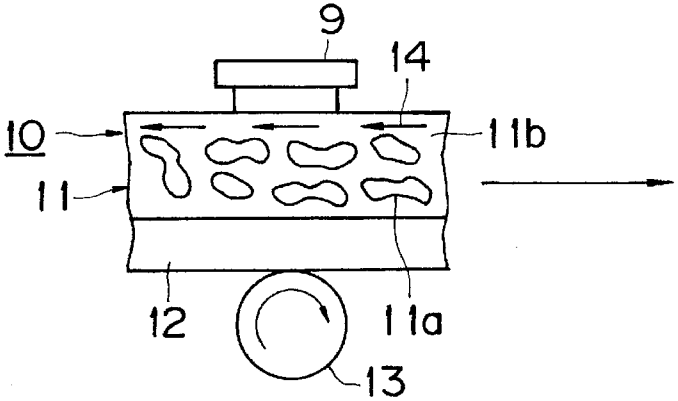
Figure 6D:
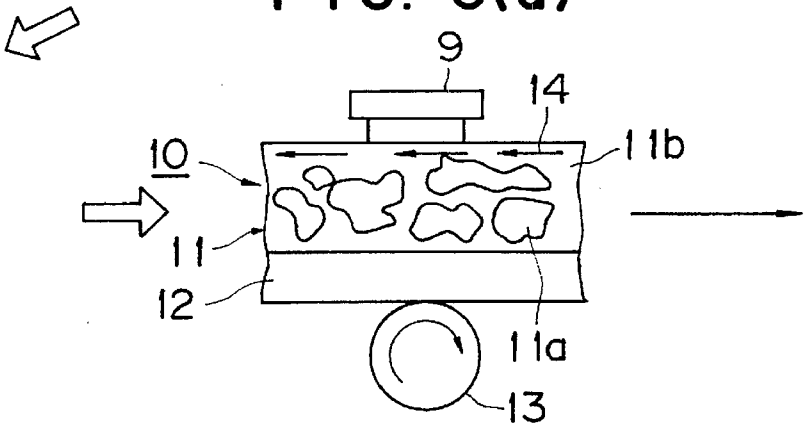

The protective layer can be scraped off the reversible thermosensitive recording layer by the method as illustrated in FIG. 5.

The above-mentioned reversible thermosensitive recording medium 31 is fixed on stainless steel plate support 32 with a thickness of 2 mm in such a posture that the protective layer thereof is situated on the top surface of the recording medium 31 as illustrated in FIG. 5.

A surface cutting member 33 which is composed of (a) a brass cylinder with a diameter of 3.5 cm and (b) a sand-paper (roughness No. 800) with which the brass cylinder is wrapped is moved, without being rotated, in the direction of the arrow in contact with the protective layer. The pressure to be applied in the vertical direction with respect to the surface of the protective layer is in the range of 1.0 to 1.5 kg/cm$^2$. The number of the repetition of the movement of the surface cutting member 33 along the protective layer is determined in accordance with the thickness of the protective layer to be scraped off the reversible thermosensitive recording layer. The thickness of the protective layer is measured prior to the scraping operation by an electronic micrometer (film thickness meter).

Even if the surface of the exposed reversible thermosensitive recording layer is toughened after the protective layer is scraped off the reversible thermosensitive recording layer, the thermal pressure level difference of the reversible thermosensitive recording layer can be properly measured without being effected by the surface roughness thereof.

In the case where an intermediate layer is interposed between the protective layer and the reversible thermosensitive layer, and also in the case where a printed layer is provided on the protective layer, and even in the case where a heat resistant film is applied to the reversible thermosensitive layer, the above-mentioned method for measuring the thermal pressure level difference can be employed by exposing the surface of the reversible thermosensitive recording layer in the same manner as mentioned above.

The previously mentioned gel percentage change ratio is a physical property of a coated resin film indicating the change ratio of the cross-linking degree of the coated resin film with time. The smaller the value of the gel percentage change ratio, the stabler the crosslinking degree of the coated resin film.

When the value of the gel percentage change ratio is 110% or less, the hardness of the coated film and the stability of the thermal physical properties of the coated film are significantly improved, so that it is considered that various properties of the reversible thermosensitive recording medium, such as repeated use durability and transparent temperature range, are significantly stabilized.

The gel percentage change ratio can be determined in accordance with the following formula:

$$G_C(\%) = \left| \frac{G_I - G_D}{G_I} \right| \times 100$$

wherein $G_C$ is the gel percentage change ratio (%), $G_I$ is the initial gel percentage (%), and $G_D$ is the gel percentage changed with time (%).

In the above, the initial gel percentage ($G_I$) is the value of the gel percentage of a sample recording layer measured for the first time after the cross-linking of the sample recording layer. This may not be necessarily the value measured immediately after the crosslinking.

The gel percentage changed with time ($G_D$) is the value of the gel percentage changed with time of a sample recording layer which is cross-linked at the same time as that of the cross-linking of the sample recording layer for the measurement of the initial gel percentage ($G_I$) thereof and is then allowed to stand at 50° C. for 24 hours.

In the present invention, the gel percentage is measured as follows:

A recording film layer with an appropriate thickness is formed on a support, and the cross-linking of the recording film layer is then performed. The cross-linked recording film layer is then peeled off the support, and the initial weight of the cross-linked recording film layer is measured.

The cross-linked recording film layer is held between a pair of 400-mesh wire nets and immersed into a solvent in which the resin prior to the above crosslinking for the recording film layer is soluble and is maintained therein for 24 hours.

The crosslinked recording film layer is then dried in vacuum, and the weight of the dried crosslinked recording film layer is measured.

The gel percentage is calculated in accordance with the following formula:

$$\text{Gel Percentage (\%)}=[\text{Weight after Drying (g)}/\text{Initial Weight (g)}]\times 100$$

When the gel percentage is calculated in accordance with the above formula, if the organic low-molecular-weight material other than the resin component is contained in the recording layer, it is necessary to remove the weight of the organic low-molecular-weight material so that the gel percentage is calculated in accordance with the following formula:

$$\text{Gel Percentage (\%)} = \frac{\text{Weight after Drying } (g)}{\text{Initial Weight } (g) - \text{Weight of Organic low-molecular material } (g)} \times 100$$

In the above, when the weight of the organic low-molecular-weight material is unknown when calculating the above gel percentage, a cross section of the recording layer is obtained by a transmission electron microscope (TEM) or a scanning electron microscope (SEM) and the ratio of the area of the organic low-molecular-weight material to the area of the resin per unit area of the cross section of the recording layer is determined, and then the ratio of the weight of the organic low-molecular-weight material to that of the resin is then calculated from the respective specific densities of the organic low-molecular-weight material and the resin. For this calculation, the weight of the organic low-molecular-weight material is obtained, whereby the above gel percentage is calculated.

Furthermore, in the case of a reversible thermosensitive recording medium comprising a support, a reversible thermosensitive recording layer formed thereon, and other layers overlaid on the reversible thermosensitive recording layer, or in the case where the previously mentioned layer is interposed between the support and the reversible thermosensitive recording layer, the thickness of each of these layers is measured by the cross-sectional observation of those layers by TEM or SEM, and the surface of the reversible thermosensitive recording layer is exposed by scraping other layers off the reversible thermosensitive recording layer by the previously mentioned method, and the reversible thermosensitive recording layer is peeled off, so that the gel percentage of the reversible thermosensitive recording layer is measured by the above-mentioned method.

In the above, when there is provided a protective layer comprising, for example, a UV resin, on the reversible thermosensitive recording layer, it is necessary to scrape such a protective layer off the reversible thermosensitive recording layer, and also to scrape the surface portion of the reversible thermosensitive recording layer slightly in order to minimize the contamination of the reversible thermosensitive recording layer with the resin component of the protective layer, whereby the gel percentage of the reversible thermosensitive recording layer can be accurately measured by preventing adverse effects of the resin component from the protective, layer on the measurement of the gel percentage.

In addition to the above, there are the following three methods of measuring the gel percentage:

In the first method, a crosslinked hardened resin film is extracted with a solvent in which the uncrosslinked resin component is soluble, for instance, for 4 hours, by use of a Soxhlet extractor, to remove the uncrosslinked resin component from the crosslinked hardened resin film, whereby the weight percentage of the unextracted residue is obtained.

In the second method, a recording film layer is formed by coating on a surface-treated PET support. The thus formed recording film layer is then subjected to electron beam (BE) radiation and immersed in a solvent. Thus, the ratio of the thickness of the recording film layer before the immersion to the thickness of the recording film layer after the immersion is obtained.

In the third method, a recording film layer is formed in the same manner as in the above second method, and 0.2 ml of a solvent is dropped on the surface of the recording film layer, then allowed to stand for 10 seconds, and wiped off the surface of the recording film layer, whereby the ratio of the thickness of the recording film layer before the dropping of the solvent to the thickness of the recording film layer after the dropping of the solvent is obtained.

In the above-mentioned first method, the gel percentage calculation is performed by removing the weight of the organic low-molecular-weight material from the initial weight of the recording film layer as mentioned previously.

In contrast to this, in the above-mentioned second and third methods, the thickness of the recording film layer is measured. Therefore, if the matrix resin which surrounds the organic low-molecular-weight material is completely crosslinked, it is considered that the thickness of the recording film layer is not changed by immersing the recording layer into the solvent, so that it is unnecessary to take the presence of the organic low-molecular-weight material into consideration in the second and third methods.

Furthermore, in the case where other layers are overlaid on the reversible thermosensitive recording layer, the above-mentioned first method can be applied as it is, while when the above-mentioned second and third methods are employed, it is necessary to scrape only the overlaid layers off the reversible thermosensitive recording layer.

The inventors of the present invention have investigated the mechanism as to why the image density and contrast are lowered during the repeated image formation and image erasure in a conventional reversible thermosensitive recording medium. More specifically, when a thermal head or a heating element of a printer for a thermal destructive type thermosensitive recording medium is brought into pressure contact with the surface of the above-mentioned conventional reversible thermosensitive recording medium, the following phenomenon is observed, which will be explained with reference to FIGS. 6(*a*) and FIG. 6(*b*). In FIGS. 6(*a*)

and 6(*b*), reference numeral 9 indicates a thermal head; reference numeral 10 indicates a conventional reversible thermosensitive recording medium, which comprises a reversible thermosensitive recording layer 11 comprising the particles of an organic low-molecular-weight material 11*a* which are dispersed in a matrix resin 11*b*, and a support 12 made of, for instance, a PET film, for supporting the reversible thermosensitive recording layer 11 thereon; and reference numeral 13 indicates a platen roller which is rotated in the direction of the arrow in contact with the support 12.

Before the application of thermal energy to the reversible thermosensitive recording medium 10 comprising the reversible thermosensitive recording layer 11 in which the particles of the organic low-molecular-weight material 11*a* are dispersed in the matrix resin 11*b*, or when the number of the application of thermal energy thereto for the image formation or image erasure is a few, such a distortion of the reversible thermosensitive recording layer 11 that changes the state of the presence of the components that constitute the recording layer 11 is so slight that the particles of the organic low-molecular-weight material 11*a* are uniformly dispersed within the recording layer 11 as illustrated in FIG. 6(*a*).

As will be explained later, the distribution of the particles of the organic low-molecular-weight material can be maintained uniform in the reversible thermosensitive recording layer of the reversible thermosensitive recording medium of the present invention even though image formation and image erasure are repeated.

In the above-mentioned conventional reversible thermosensitive recording medium 10, however, when image formation means such as the thermal head 9 is moved relative to the reversible thermosensitive recording medium 10 in pressure contact with the surface thereof, stress is applied to the inside of the recording layer 11, so that while the energy application in the same direction is repeated, the distortion as illustrated in FIG. 6(*b*) is formed mainly because of the application of the above-mentioned stress. As a result, the particles of the organic low-molecular-weight material 11*a* are deformed as illustrated in FIG. 6(*c*). With further repetition of the application of the energy in the same direction, the above-mentioned distortion is further developed, so that the deformed particle of the organic low-molecular-weight material 11*a* begin to aggregate as illustrated in FIG. 6(*d*). Finally, the aggregated particles are further caused to aggregate to form aggregated particles with a maximum particle size. When the organic low-molecular-weight material 11*a* is in such a state, it is almost impossible to perform image formation in the reversible thermosensitive recording medium 10. This is a so-called deterioration state. It is considered that such a state brings about the lowering of image density when the reversible thermosensitive recording medium 10 is used repeated for image formation and image erasure.

When the reversible thermosensitive recording layer is transparent, the particles of the organic low-molecular-weight material are dispersed in the matrix resin in close contact with the matrix resin. In other words, there is no gap between the particles of the organic low-molecular-weight material and the matrix resin. Furthermore, there is no gap within each particle of the organic low-molecular-weight material. Therefore, light which enters one side of the reversible thermosensitive recording layer passes through the recording layer and emits from the other side of the recording layer, without being scattered, so that the reversible thermosensitive recording layer looks transparent.

When the reversible thermosensitive recording layer is milky white, the particles of the organic low-molecular-weight material are composed of fine crystals of the organic low-molecular-weight material, there are gaps at the interface between the crystals of the organic low-molecular-weight material and/or at the interface between the crystals of the organic low-molecular-weight material and the matrix resin, so that the light which enters one side of the reversible thermosensitive recording layer is scattered at the interface between the gaps and the crystals of the organic low-molecular-weight material and the matrix resin and at the interface between the gaps and the matrix resin. As a result, the reversible thermosensitive recording layer looks milky white.

Figure 7:
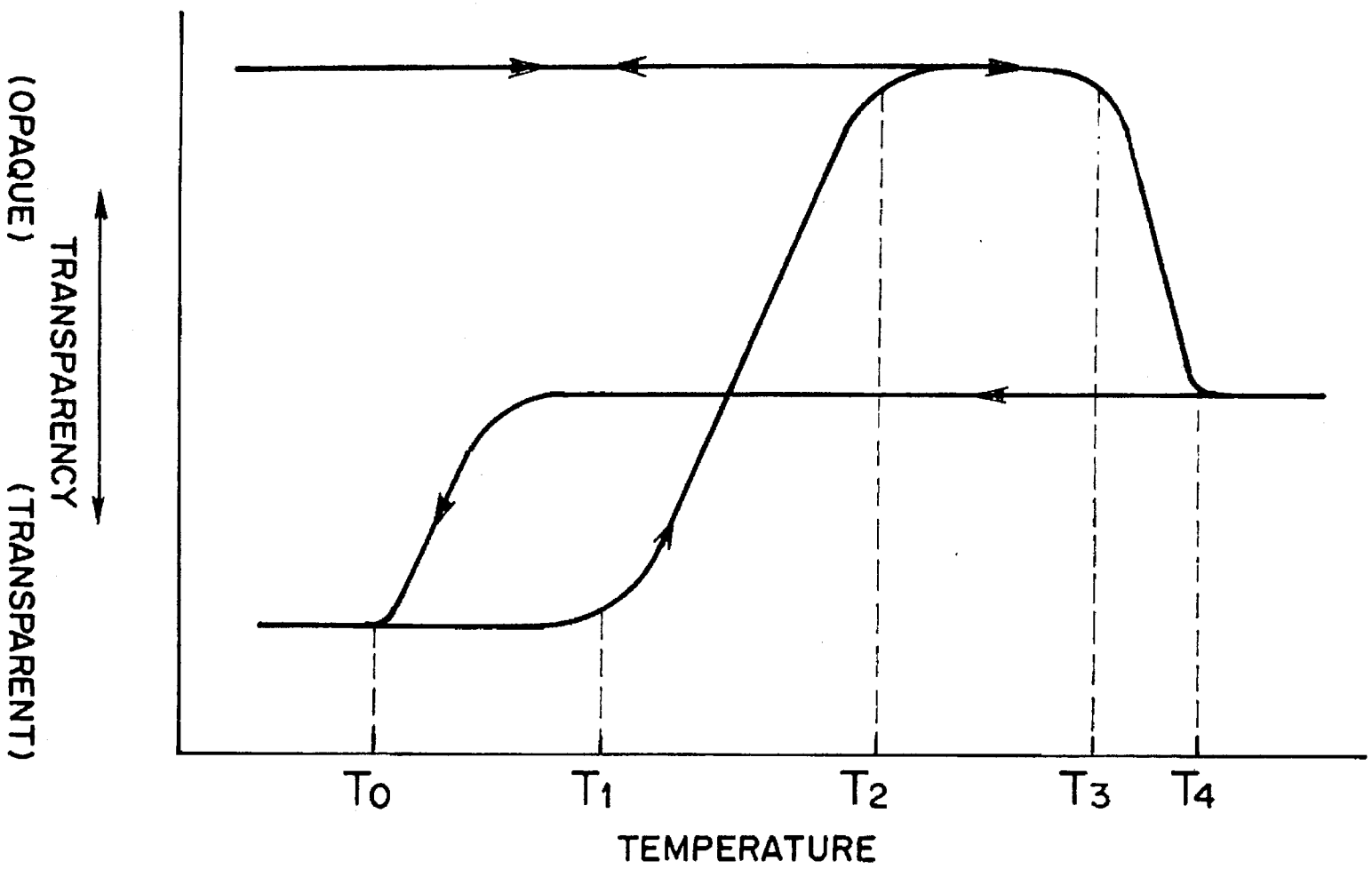
FIG. 7 is a diagram showing the changes in the transparency of the reversible thermosensitive recording layer of the reversible thermosensitive recording medium of the present invention.
Figure 8A:
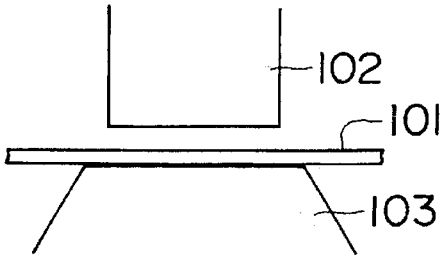
FIG. 8(*a*) schematically shows a thermosensitive recording image display apparatus of a pressure contact type.
Figure 8B:
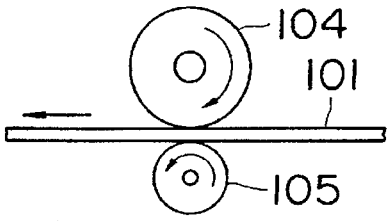
Figure 8C:
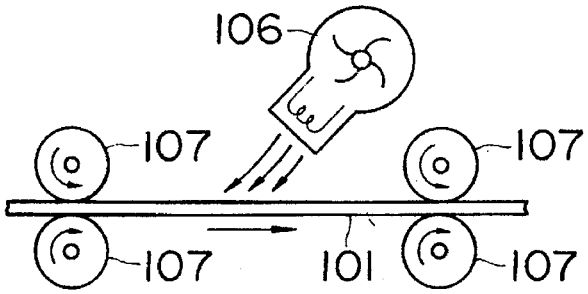
Figure 8D:
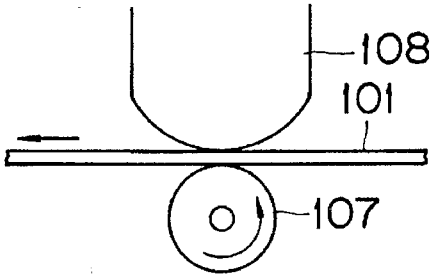

FIG. 7 is a diagram showing the changes in the transparency of the reversible thermosensitive recording layer (hereinafter referred to as the recording layer) comprising as the main components the matrix resin and the particles of the organic low-molecular-weight material which are dispersed in the matrix resin.

It is supposed that the recording layer is in a milky white opaque state at temperature $T_0$ which is room temperature or below room temperature.

When the temperature of the recording layer is raised by the application of heat thereto, the recording layer gradually begins to become transparent at temperature $T_1$. The recording layer becomes transparent when heated to a temperature in the range of $T_2$ to $T_3$. Even when the temperature of the recording layer in such a transparent state is decreased back to room temperature, the transparent state is maintained. This is because when the temperature of the recording layer reaches a temperature near $T_1$, the matrix resin begins to be softened, so that the gaps at the interface between the matrix resin and the particles of the organic low-molecular-weight material, and the gaps within the particles of the low-molecular-weight material are decreased, so that the transparency of the recording layer is gradually increased. When the temperature of the recording layer reaches $T_2$ to $T_3$, the organic low-molecular-weight material is in a half-melted state, so that the remaining gaps are filled with the organic low-molecular-weight material. As a result, the recording layer becomes transparent. The recording layer in such a transparent state, however, still contains seed crystals of the organic low-molecular-weight material. When the recording layer in such a transparent state is cooled, the organic low-molecular-weight material is crystallized while it is still at a relatively high temperature, and the matrix resin is in a softened state at the relatively high temperature. When the recording layer is further cooled, the changes in the volume of the matrix resin follow the changes in the volume of the organic low-molecular-weight material in accordance with the crystallization, without forming the gaps therebetween, so that the transparent state is maintained even when the recording layer is cooled.

When the recording layer at a temperature in the range of $T_2$ to $T_3$ is heated to temperature $T_4$ or a temperature above $T_4$, the recording layer assumes a semi-transparent state with a transparency between the maximum transparent state of the recording layer and the maximum opaque state thereof.

When the temperature of the recording layer in such a semi-transparent state is decreased, the recording layer assumes the initial milky white state again, without assuming any transparent state during the cooling process.

This is because the organic low-molecular weight material is completely melted when heated to temperature $T_4$ or a temperature above $T_4$, and when the temperature of the melted organic low-molecular-weight material is decreased, the organic low-molecular-weight material is supercooled and crystallized at a temperature slightly higher than temperature $T_O$. It is considered that, in this case, the matrix resin cannot follow up the changes in the organic low-molecular-weight material caused by the crystallization thereof, so that gaps are formed between the matrix resin and the organic low-molecular-weight material, and the recording layer assumes the initial milky white state.

The temperature—transparency changes curves shown in FIG. 7 are representative examples and therefore such curves may be different from the curves shown in FIG. 7, depending upon the materials employed in the recording layer.

Thus, the softening point of the matrix resin and the deformation behavior of the matrix resin when heated to a temperature above the softening point thereof are important factors for the changes of the transparency of the recording layer.

As mentioned previously, when the hardening degree of the matrix resin for use in the recording layer is increased, the softening point of the matrix resin is also increased, and at the same time, the deformation behavior of the matrix resin when heated to a temperature above the softening point thereof is changed. It is considered that in a conventional reversible thermosensitive recording medium, the decreasing of the transparent temperature range of the recording layer thereof with time during repeated use thereof is closely related to the properties of the matrix resin for use in the recording layer thereof.

As mentioned previously, the inventors of the present invention have discovered that the object of the present invention, that is, the provision of a reversible thermosensitive recording medium which is improved with respect to the stability of the transparent temperature range with time and the repeated use durability thereof, can be achieved by use of the reversible thermosensitive recording layer having a thermal pressure level difference of 40% or less, and a change ratio of the thermal pressure level difference of 70% or less.

For achieving the above object of the present invention, it is preferable that the reversible thermosensitive recording medium further comprise a protective layer which is situated above the reversible thermosensitive recording layer; that the reversible thermosensitive recording layer comprise a cross-linked resin; and that the resin comprise at least one resin component selected from the group consisting of polyvinyl chloride, chlorinated polyvinyl chloride, polyvinylidene chloride, saturated polyester, polyethylene, polypropylene, polystyrene, poly-methacrylate, polyamide, polyvinyl pyrrolidone, natural rubber, polyacrolein, and polycarbonate, or the resin be a copolymer comprising any of the above-mentioned resin components.

In the reversible thermosensitive recording medium of the present invention, since the thermal pressure level difference of the reversible thermosensitive recording layer is 40% or less, which is much smaller than that of the reversible thermosensitive recording layer, the repeated use durability of the recording medium is particularly improved. It is considered that this is because the heat resistance and mechanical strength of the reversible thermosensitive recording layer are significantly improved.

Furthermore, when the particles of the organic low-molecular-weight material are contained in the reversible thermosensitive recording layer, the aggregation of the particles of the organic low-molecular-weight material and the maximizing the particle size thereof are difficult to take place and therefore the deterioration of the reversible thermosensitive recording layer after repeated image formation and image erasure can be minimized and high contrast can be obtained for an extended period of time.

For obtaining the above-mentioned effect, it is preferable that the thermal pressure level difference be 40% or less, more preferably 30% or less, and most preferably 20% or less.

When the change ratio of the thermal pressure level difference of the reversible thermosensitive recording layer is 70% or less, it is effective for preventing the transparent temperature range from decreasing while in use. It is considered that this is because in the present invention, there are substantially no changes in the physical properties of the reversible thermosensitive recording layer with time, so that the transparent temperature range of the reversible thermosensitive recording layer is not varied, and the width of the transparent temperature range is not decreased, whereby the image erasure characteristics of the reversible thermosensitive recording layer are stabilized.

For obtaining the above-mentioned effect, it is preferable that the change ratio of the thermal pressure level difference of the reversible thermosensitive recording layer be 70% or less, more preferably 50% or less, furthermore preferably 45% or less, most preferably 40% or less.

In order to obtain the above-mentioned change ratio of the thermal pressure level difference of 70% or less, it is necessary that the matrix resin employed in the reversible thermosensitive recording layer maintain a certain hardness when the matrix resin is heated to high temperature. Specific preferable examples of a resin to be used as such matrix resin include a resin having high softening temperature, a resin comprising a main-chain resin component having high softening temperature and a side-chain resin component having low-temperature softening point, and a crosslinked resin.

As mentioned previously, the inventors of the present invention have further discovered that the object of the present invention can also be achieved by crosslinking the resin to be contained in the reversible thermosensitive recording layer in such a manner that the resin is caused to have a gel percentage change ratio of 110% or less.

In this case, for obtaining the above-mentioned effect, it is preferable that the gel percentage ratio be 30% or more, and it is more preferable that the resin be crosslinked by use of a cross-linking agent. It is further more preferable that the resin be crosslinked by electron beam or ultraviolet light radiation.

In the reversible thermosensitive recording medium of the present invention, the gel percentage change ratio of the resin contained in the reversible thermosensitive recording layer, when cross-linked, is so extremely small that, that is, the deterioration of the hardness of the resin with time is so small, that the previously mentioned erasure characteristics of the reversible thermosensitive recording medium of the present invention are considered to be stabilized.

For obtaining the above-mentioned effect, it is preferable that the gel percentage change ratio of the resin be 110% or less, more preferably 90% or less, furthermore preferably 70% or less, and most preferably 50% or less.

Furthermore, in the reversible thermosensitive recording medium of the present invention, it is considered that the crosslinked resin has so high a gel percentage ratio that the heat resistance and mechanical strength of the previously mentioned image display portion are further improved and therefore the repeated use durability of the image display portion is improved, and the formation of printing marks and cracks in the image display portion can be effectively prevented.

For obtaining this effect, it is preferable that the value of the gel percentage be 30% or more, more preferably 50% or more, furthermore preferably 70% or more.

The resin contained in the reversible thermosensitive recording layer can be crosslinked by the application of heat, ultraviolet light radiation and electron beam radiation. For this purpose, ultraviolet light radiation and electron beam radiation are preferable, and of these two radiation methods, electron beam radiation is more preferable.

The reasons why the crosslinking method by electron beam radiation is excellent are as follows.

The significant differences between the crosslinking of resin by electron beam radiation (hereinafter referred to as EB crosslinking) and the crosslinking of resin by ultraviolet light radiation (hereinafter referred to as UV crosslinking) are as follows:

In UV crosslinking, a photopolymerization initiator and a photosensitizer are necessary. The resins for UV crosslinking are mostly limited to resins having transparency. In contrast to this, in EB crosslinking, the concentration of radicals is so high that the crosslinking reaction proceeds rapidly, so that the polymerization is terminated instantly. Furthermore, EB radiation can provide more energy than UV radiation can so that the reversible thermosensitive recording layer can be made thicker than that for UV radiation.

Furthermore, as mentioned above, in UV crosslinking, a photopolymerization initiator and a photosensitizer are necessary, so that when the crosslinking reaction has been completed, the additives remain in the reversible thermosensitive recording layer and there may be the risk that these additives have adverse effects on the image formation performance, image erasure performance, and repeated use durability of the reversible thermosensitive recording layer.

The significant differences between EB crosslinking and thermal crosslinking are as follows:

In thermal crosslinking, a catalyst for crosslinking and a promoting agent are required. Even though the catalyst and promoting agent are employed, the speed of crosslinking reaction by thermal crosslinking is considerably slower than that of the crosslinking reaction by EB crosslinking. Furthermore, in the case of thermal crosslinking, additives such as the above-mentioned catalyst and promoting agent remain in the reversible thermosensitive recording layer after the crosslinking reaction in the same manner as in UV crosslinking and therefore thermal crosslinking has the same shortcomings as UV crosslinking does. Furthermore, since the above-mentioned catalyst and promoting agent remain in the reversible thermosensitive recording layer, the crosslinking reaction may slightly proceed after the initial crosslinking so that it is possible that the recording characteristics of the reversible thermosensitive recording layer may change with time.

For the above-mentioned reasons, EB radiation is the most suitable for the crosslinking the resin in the reversible thermosensitive recording layer in the present invention.

The reversible thermosensitive recording layer whose transparency or color reversibly changes by the application of heat thereto for use in the reversible thermosensitive recording medium of the present invention is capable of changing its transparency or color reversibly in a visible form. Generally visible changes can be classified into changes in color and changes in form.

In the present invention, materials which mainly change in color are employed for the reversible thermosensitive recording layer.

The changes in color include changes in transparency, reflection, absorption wavelength, and the degree of scattering.

In the reversible thermosensitive recording medium for use in practice, image display is carried out by use of a combination of the above-mentioned changes. More specifically, any reversible thermosensitive recording layers can be used as long as the transparency or color thereof is reversibly changed by the application of heat thereto. A specific example of such a reversible thermosensitive recording layer assumes a first colored state at a first specific temperature which is above room temperature. When this reversible thermosensitive recording layer is heated to a second specific temperature which is above the first specific temperature and then cooled, the reversible thermosensitive recording layer assumes a second colored state.

In particular, reversible thermosensitive recording media which are capable of assuming two respective different colored states at a first, specific temperature and at a second specific temperature.

For example, Japanese Laid-Open Patent Application 55-154198 discloses a reversible thermosensitive recording medium which assumes a transparent state at a first specific temperature and a milky white state at a second specific temperature. Japanese Laid-Open Patent Applications 4-224996, 4-247985 and 4-267190 disclose reversible thermosensitive recording media which assume a colored state at a second specific temperature and a decolorized state at a first specific temperature. Japanese Laid-Open Patent Application 3-169590 assumes a milky white state at a first specific temperature and a transparent state at a second specific temperature. Japanese Laid-Open Patent Applications 2-188293 and 2-188294 disclose reversible thermosensitive recording media which assume a colored state with a color such as black, red or blue at a first specific temperature, and a decolorized state at a second specific temperature.

Of the above-mentioned reversible thermosensitive recording layers, the following two, types of reversible thermosensitive recording layers are representative:

(1) Reversible thermosensitive recording layers which are capable of reversibly assuming a transparent state and a milky white state, which are referred to as type 1.

(2) Reversible thermosensitive recording layers which are capable of reversibly assuming a colored state by the chemical changes of a dye or the like, which are referred to as type 2.

A representative example of a thermosensitive recording layer of type 1 is a thermosensitive recording layer comprising a matrix resin such as polyester and an organic low-molecular-weight material such as higher alcohol or higher fatty acid which is dispersed in the matrix resin.

A representative example of a thermosensitive recording layer of type 2 is a leuco type thermosensitive recording layer with the reversibility of the color changes is intensified.

As mentioned above, the thermosensitive recording layer of type 1 which is capable of reversibly changing its transparency comprises as the main components a matrix resin and an organic low-molecular weight material which is dispersed in the matrix resin. The reversible thermosensitive recording material for the thermosensitive recording of this type has a transparent temperature range as mentioned previously.

The reversible thermosensitive recording medium of the present invention utilizes the reversible changes in the transparency thereof (from a transparent state to a milky white state and vice versa) as described previously. The difference between the transparent state and the milky white state has been explained with reference to FIG. 7.

In the reversible thermosensitive recording medium of the present invention, it is possible to form milky white images on the transparent background and to form transparent images on the milky white background by selective heat application to the reversible thermosensitive recording layer thereof, and such changes in the transparency of the thermosensitive recording layer can be repeated as desired. When a colored sheet is placed behind such a reversible thermosensitive recording layer, images with the color of the colored sheet can be formed on the milky white background, or milky white images on the background with the color of the colored sheet can be formed.

When images formed on the reversible thermosensitive recording layer are projected on a screen by use of an overhead projector (OHP), the milky white portions on the reversible thermosensitive recording layer correspond to the dark portions on the screen, and the transparent portions on the reversible thermosensitive recording layer correspond to the light portions on the screen.

It is preferable that the thickness of the reversible thermosensitive recording layer be in the range of 1 to 30 μm, more preferably in the range of 2 to 20 μm. When the reversible thermosensitive recording layer is excessively thick, the thermal distribution in the recording layer becomes non-uniform so that it becomes difficult to uniformly make the recording layer transparent. On the other hand, when the reversible thermosensitive recording layer is excessively thin, the milky white opaque degree thereof is decreased so that the contrast of formed images is lowered. The milky white opaque degree of the reversible thermosensitive recording layer can be increased by increasing the amount of a fatty acid to be contained as the organic low-molecular-weight material in the recording layer.

The reversible thermosensitive recording medium comprising the reversible thermosensitive recording layer of type 1 can be fabricated by providing the reversible thermosensitive recording layer on a support by the following methods. The reversible thermosensitive recording layer can be made in the form of a sheet without using the support as the case may be.

(1) A matrix resin and an organic low-molecular-weight material are dissolved in a solvent. This solution is coated on a support. The solvent of the coated solution is then evaporated to form a film-shaped layer or sheet, and the film-shaped layer or sheet is simultaneously crosslinked on the support. The crosslinking may be performed after the formation of the film-shaped layer or sheet.

(2) A matrix resin is dissolved in a solvent in which only the matrix resin is soluble. An organic low-molecular-weight material is pulverized by various methods and dispersed in the above matrix resin solution. The above dispersion is then coated on a support. The solvent of the coated dispersion is then evaporated to form a film-shaped layer or sheet, and the film-shaped layer or sheet is simultaneously crosslinked on the support. The crosslinking may be performed after the formation of the film-shaped layer or sheet.

(3) A matrix resin and an organic low-molecular-weight material are melted with the application of heat thereto without using a solvent. The thus melted mixture is formed into a film or sheet and cooled. The thus formed film or sheet is then crosslinked.

As the solvents for forming a reversible thermosensitive recording layer or a reversible thermosensitive recording medium, varieties of solvents can be employed in accordance with the kinds of the matrix resin and organic low-molecular-weight material to be employed. Specific examples of such solvents include tetrahydrofuran, methyl ethyl ketone, methyl isobutyl ketone, chloroform, carbon tetrachloride, ethanol, toluene, and benzene.

The organic low-molecular-weight material is present in a dispersed state in the form of finely-divided particles in the reversible thermosensitive recording layer not only when the reversible thermosensitive recording layer is formed by coating the above-mentioned dispersion, but also when the reversible thermosensitive recording layer is formed by coating the above-mentioned solution.

In the present invention, as the matrix resin for the reversible thermosensitive recording layer of the reversible thermosensitive recording medium, a resin that can be formed into a film layer or sheet and has excellent transparency and stable mechanical strength is preferable.

Such a resin may comprise at least one resin component selected from the group consisting of polyvinyl chloride, chlorinated polyvinyl chloride, polyvinylidene chloride, saturated polyester, polyethylene, polypropylene, polystyrene, polymethacrylate, polyamide, polyvinyl pyrrolidone, natural rubber, polyacrolein, and polycarbonate; or may be a copolymer comprising any of the above-mentioned resin components.

More specifically, as the above-mentioned resin, the following resins can be employed: polyvinyl chloride; vinyl chloride copolymers such as vinyl chloride—vinyl acetate copolymer, vinyl chloride—vinyl acetate—vinyl alcohol copolymer, vinyl chloride—vinyl acetate maleic acid copolymer, and vinyl chloride—acrylate copolymer; polyvinylidene chloride; vinylidene chloride copolymers such as vinylidene chloride—vinyl chloride copolymer, and vinylidene chloride—acrylonitrile copolymer; polymethacrylate; and methacrylate copolymer.

In the case where vinyl chloride copolymer is employed as the matrix resin, it is preferable that the average polymerization degree (p) be 300 or more, more preferably 600 or more, and the weight ratio of the vinyl chloride unit to a copolymerizable unit be in the range of 90/10 to 60/40, more preferably in the range of 85/15 to 65/35.

It is preferable that matrix resins for use in the reversible thermosensitive recording layer in the present invention have a glass transition temperature (Tg) of less than 100° C., more preferably less than 90° C., and most preferably less than 80° C.

It is required that the organic low-molecular-weight material for use in the present invention can be formed in the shape of particles in the reversible thermosensitive recording layer. It is preferable that the organic low-molecular-weight material have a melting point in the range of 30° to 200° C., more preferably in the range of 50° to 150° C.

Specific examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned organic low-molecular-weight material be in the range of 10 to 60, more preferably in the range of 10 to 38, furthermore preferably in the range of 10 to 30. Part of the alcohol groups in the esters may be saturated or unsaturated, and further may be substituted by a halogen. In any case, it is preferable that the organic low-molecular-weight material have at least one atom selected from the group consisting of oxygen, nitrogen, sulfur and a halogen in its molecule. More specifically, it is preferable the organic low-molecular-weight materials comprise, for instance, —OH, —COOH, —CONH, —COOR, —NH, —$NH_2$, —S—, —S—S—, —O— or a halogen atom.

In the present invention, it is preferable to use a composite material comprising an organic low-molecular-weight material having a low melting point and an organic low-molecular-weight material having a high melting point as the above-mentioned organic low-molecular-weight material, since the transparent temperature range of the reversible thermosensitive recording layer can be increased by use of such a composite material as the organic low-molecular-weight material. It is preferable that the difference in the melting point between the low-melting point organic low-molecular-weight material and the high melting point organic low-molecular weight material be 20° C. or more, more preferably 30° C. or more, most preferably 40° C. or more.

It is preferable that the low-melting point organic low-molecular-weight material have a melting point in the range of 40° C. to 100° C., more preferably in the range of 50° C. to 80° C., and that the high-melting point organic low-molecular-weight material have a melting point in the range of 100° C. to 200° C., more preferably in the range of 110° C. to 180° C.

As the low-melting point organic low-molecular-weight material for use in the present invention, a fatty acid ester which will be explained in detail later, a dibasic acid ester, a polyhydric alcohol di-fatty acid ester are preferable. These low-melting point organic low-molecular-weight materials can be used alone or in combination.

The above-mentioned fatty acid ester for use in the present invention is characterized in that the fatty acid ester has a melting point lower than that of the corresponding fatty acid having the same number of carbon atoms as that of the fatty acid ester, which is in an associated state of the two molecules thereof, and includes more carbon atoms than fatty acids having the same melting point as that of the fatty acid ester.

It is considered that the deterioration of the reversible thermosensitive recording layer during repeated image formation and image erasure is caused by the changes in the dispersion state of the organic low-molecular-weight material. It is also considered that such changes in the dispersion state of the organic low-molecular-weight material are caused by the matrix resin and the organic low-molecular-weight material becoming compatible (soluble in each other) during the application of heat to the reversible thermosensitive recording layer. The compatibility between the matrix resin and the organic low-molecular-weight material is decreased as the number of carbon atoms in the organic low-molecular-weight material is increased. Therefore it is considered that as the compatibility between the matrix resin and the organic low-molecular-weight material is decreased, the deterioration of the reversible thermosensitive recording layer during repeated image formation and image erasure is reduced. Furthermore, there is the tendency that the milky white opaqueness of the reversible thermosensitive recording layer is increased as the number of carbon atoms of the organic low-molecular-weight material is increased.

For these reasons, it is considered that the milky white opaqueness, image contrast and repeated use durability of the reversible thermosensitive recording layer can be improved by using such a fatty acid ester as the organic low-molecular-weight material to be dispersed in the matrix resin in comparison with the case where a fatty acid having the same melting point as that of the fatty acid ester is used as the organic low-molecular-weight material to be dispersed.

By using such a fatty acid ester in combination with the high-melting point organic low-molecular-weight material, the transparent temperature range of the reversible thermosensitive recording layer can be broadened, and the image erasure performance thereof when a thermal head is employed can be improved. Thus, even if the image erasure performance of the reversible thermosensitive recording layer is changed more or less during the storage of the recording medium, images can still be erased without problems. Because of the above-mentioned particular properties of the organic low-molecular-weight material, the repeated use durability of the thermosensitive recording layer can be improved.

An example of the fatty acid ester for use in the present invention is a fatty acid ester having the following formula (I):

$$R_1—COO—R_2 \quad (I)$$

wherein $R_1$ and $R_2$ are an alkyl group having 10 or more carbon atoms.

It is preferable that the number of carbon atoms of the fatty acid ester be 20 or more, more preferably 25 or more, and further more preferably 30 or more. As the number of carbon atoms of the fatty acid is increased, the milky white opaqueness of the reversible thermosensitive recording layer is increased and the repeated use durability thereof is also increased.

It is preferable that the melting point of the above fatty acid ester be 40° C. or more. Such fatty acid esters may be used alone or in combination.

Representative examples of the above-mentioned fatty acid ester are as follows: octadecy palmitate, docosyl palmitate, heptyl stearate, octyl stearate, docosyl stearate, octadecyl behenate, and docosyl behenate.

As the di-basic acid ester, a monoester and a diester, which can be represented by the following formula (II), can be employed:

$$ROOC—(CH_2)_n—COOR' \quad (II)$$

wherein R and R' are a hydrogen atom, or an alkyl group having 1 to 30 carbon atoms, provided that R and R' may be the same or different, but cannot be a hydrogen atom at the same time, and n is an integer of 0 to 40.

In the above di-basic acid ester, it is preferable that the number of the alkyl group represented by R or R' be 1 to 22, and that n be 1 to 30, more preferably 2 to 20. It is also preferable that the di-basic acid ester have a melting point of 40° C. or more.

Specific examples of the above, di-basic acid ester are succinic acid ester, sebacic acid ester, and 1,18-octadecamethylene dicarboxylic acid ester.

The polyhydric alcohol di-fatty acid ester of the following formula (III) can be used as the organic low-molecular-weight material in the present invention:

$$CH_3(CH_2)_{m-2}COO(CH_2)_nOOC(CH_2)_{m-2}CH_3$$

wherein n is an integer of 2 to 40, preferably an integer of 3 to 30, more preferably an integer of 4 to 22; and m is an integer of 2 to 40, preferably an integer of 3 to 30, more preferably an integer of 4 to 22.

Specific examples of the polyhydric alcohol di-fatty acid ester are 1,3-propanediol dialkanoic acid ester, 1,6-hexanediol dialkanoic acid ester, 1,10-decanediol dialkanoic acid ester, and 1,18-octadecanediol dialkanoic acid ester.

When polyhydric alcohol di-fatty acid esters and di-fatty acids both of which have the same number of carbon atoms are compared, the polyhydric alcohol di-fatty acid esters have lower melting points than the difatty acids. On the other hand, when the polyhydric alcohol di-fatty acid esters and di-fatty acids both of which have the same melting point are compared, the polyhydric alcohol di-fatty acid esters contain more carbon atoms than the difatty acids.

As mentioned previously, it is considered that the repeated use durability of the reversible thermosensitive recording layer of the reversible thermosensitive recording medium is closely related to the compatibility of the matrix resin and the organic low-molecular-weight material in the reversible thermosensitive recording layer when heated. Furthermore, the compatibility of the matrix resin and the organic low-molecular-weight material is considered to be lowered as the number of carbon atoms of the organic low-molecular-weight material is increased.

Furthermore, there is the tendency that the milky white opaqueness of the reversible thermosensitive recording layer is increased as the number of carbon atoms of the organic low-molecular-weight material is increased. Therefore the repeated use durability of the reversible thermosensitive recording layer can be improved by using the polyhydric alcohol di-fatty acid ester rather than by using the fatty acid having the same melting point as that of the polyhydric alcohol di-fatty acid ester.

The polyhydric alcohol di-fatty acid esters have low melting points and impart to the reversible thermosensitive recording layer substantially the same milky white opaqueness and repeated use durability as those imparted by fatty acids having higher melting points than those of the polyhydric alcohol di-fatty acid esters.

Therefore, when a polyhydric alcohol di-fatty acid ester is used in combination with an organic low-molecular-weight material having a melting point which is higher than the melting point of the polyhydric alcohol di-fatty acid ester, the transparent temperature range of the reversible thermosensitive recording layer can be expanded with the maintenance of substantially the same milky white opaqueness and repeated use durability as those obtained when a fatty acid is employed.

Because of the above-mentioned advantage of the polyhydric alcohol di-fatty acid esters, the image erasure performance for making the recording layer transparent by the application of heat thereto for a short period of time, for instance, by a thermal head, can be significantly improved and the range for effecting the image erasure performance can be expanded. Therefore, even when thermal energy applied for image erasure is varied, images can be erased by a thermal head without causing any problems in practice.

Specific examples of the above-mentioned organic low-molecular-weight material having a melting point which is higher than the melting point of the polyhydric alcohol di-fatty acid ester for use in the present invention, which is hereinafter referred to as the high-melting point organic low-molecular-weight material, are aliphatic saturated dicarboxylic acids, ketones having a higher alkyl group, semicarbazone, and α-phosphonofatty acids, and are not limited to these compounds. compounds can be used alone or in combination. These Examples of organic low-molecular-weight materials having melting points of 100° C. or more will now be described.

Specific examples of aliphatic dicarboxylic acids having melting points in the range of about 100° C. to 135° C. are as follows: succinic acid, glutaric acid, adipic acid, pimelic acid, suberic acid, azelaic acid, sebacic acid, undecanedioic acid, dodecanedioic acid, tetradecanedioic acid, pentadecanedioic acid, hexadecanedioic acid, heptadecanedioic acid, octadecanedioic acid, nonadecanedioic acid, eicosanedioic acid, heneicosanedioic acid, and docosanedioic acid.

The ketones for use in the present invention have a ketone group and a higher alkyl group as indispensable constituent groups. The ketones may also have an unsubstituted or substituted aromatic group or heterocyclic group.

It is preferable that the entire number of carbon atoms contained in such ketones be 16 or more, more preferably 21 or more.

The semicarbazone for use in the present invention is derived from the above-mentioned ketones.

Specific examples of the ketones and semicarbazone for use in the present invention include 3-octadecanone, 7-eicosanone, 14-heptacosanone, 18-pentatriacontanone, tetradecaphenone, docosaphenone, docosanonaphthophenone, and 2-heneicosanosemicarbazone.

The α-phosphonofatty acids for use in the present invention can be obtained by the following steps:

A fatty acid is brominated to obtain an α-brominated acid bromide by Hell-Volhard-Zelinskin reaction in accordance with the method by E. V. Kaurer et al. (J. Ak. Oil Chekist's Soc. 41, 205 (1964)).

Ethanol is added to the α-brominated acid bromide to obtain an α-bromofatty acid ester.

The α-bromofatty acid ester is allowed to react with triethyl phosphite with the application of heat thereto, whereby an α-phosphonofatty acid ester.

The thus obtained α-phosphonofatty acid ester is hydrolyzed in the presence of concentrated hydrochloric acid. The product obtained by this hydrolysis is recrystallized from toluene, whereby the α-phosphonofatty acid for use in the present invention is obtained.

Specific examples of the α-phosphonofatty acid for use in the present invention are α-phosphonomyristic acid, α-phosphonoplamitic acid, and α-phosphonostearic acid.

It is preferable that the mixing ratio by weight of the low-melting-point organic low-molecular-weight material: the high-melting-point organic low-molecular-weight material be 95:5 to 5:95, more preferably 90:10 to 10:90, further more preferably 80:20 to 20:80.

In addition to the above-mentioned low-melting-point and high-melting-point organic low-molecular-weight materials, other organic low-molecular-weight materials may be used in combination.

Examples of such organic low-molecular-weight materials include higher fatty acids such as lauric acid, dodecanoic acid, myristic acid, pentadecanoic acid, palmitic acid, stearic acid, behenic acid, nonadecanoic acid, arachic acid, and oleic acid; and the following ethers and thioethers:

$$C_{16}H_{33}-O-C_{16}H_{33},\quad C_{16}H_{33}-S-C_{16}H_{33},$$

-continued $C_{18}H_{37}-S-C_{18}H_{37}$, $C_{12}H_{25}-S-C_{12}H_{25}$, $C_{19}H_{39}-S-C_{19}H_{39}$, $C_{12}H_{25}-S-S-C_{12}H_{25}$,

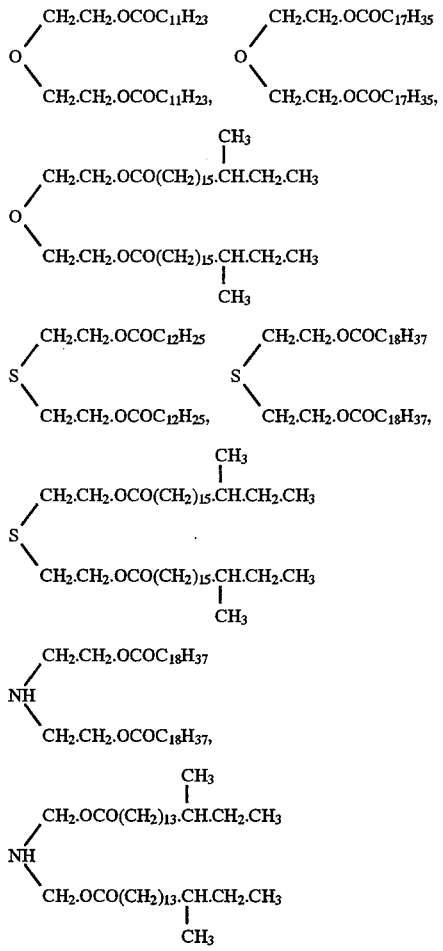

Of the above-mentioned compounds, higher fatty acids having 16 or more carbon atoms, more preferably higher fatty acids having 16 to 24 carbon atoms, such as palmitic acid, pentadecanoic acid, nonadecanoic acid, arachic acid, stearic acid, behenic acid and lignoceric acid are preferred in the present invention.

As mentioned previously, in order to expand the transparent temperature range of the reversible thermosensitive recording layer in the present invention, the above-mentioned organic low-molecular-weight materials may be appropriately used in combination. Alternatively, any of the above-mentioned organic low-molecular-weight materials and other materials having different melting points from the melting points of the above-mentioned organic low-molecular-weight materials may be used in combination. Such materials are disclosed in Japanese Laid-Open Patent Applications 63-39378 and 63-130380, and Japanese Applications 63-14754 and 3-2089, but the materials to be used in combination with the above-mentioned organic low-molecular-weight materials are not limited to the materials proposed in the above references.

It is preferable that the ratio by weight of the organic low-molecular-weight material to the matrix resin which is a resin having a crosslinked structure be in the range of 2:1 to 1:16, more preferably in the range of 1:2 to 1:8.

When the amount of the resin is in the above-mentioned range, a resin film which can hold the organic low-molecular-weight material can be appropriately formed, and which can be reversible made transparent, can be prepared.

In addition to the above-mentioned components, additives such as a surfactant and a plasticizer may be added to the reversible thermosensitive recording layer in order to facilitate the formation of transparent images.

Examples of the plasticizer include phosphoric ester, fatty acid ester, phthalic acid ester, dibasic acid ester, glycol, polyester-based plasticizers, and epoxy plasticizers.

Specific examples of such plasticizers are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol di-2-ethyl butyrate, methyl acetylricinoleate, butyl acetylricinoleate, butylphthalyl butyl glycolate and tributyl acetylcitrate.

Specific examples of the surfactant and other additives are polyhydric alcohol higher fatty acid esters; polyhydric alcohol higher alkyl ethers; lower olefin oxide adducts of polyhydric alcohol higher fatty acid ester, higher alcohol, higher alkyl phenol, higher alkyl amine of higher fatty acid, amide of higher fatty acid, fat and oil, and propylene glycol; acetylene glycol; sodium, calcium, barium and magnesium salts of higher alkylbenzenesulfonic acid; calcium, barium and magnesium salts of aromatic carboxylic acid, higher aliphatic sulfonic acid, sulfonic monoester, phosphoric monoester and phosphoric diester; lower sulfated oil; long-chain polyalkyl acrylate; acrylic oligomer; long-chain polyalkyl methacrylate; long-chain alkyl methacrylate—amine-containing monomer copolymer; styrene—maleic anhydride copolymer; and olefin—maleic anhydride copolymer.

A reversible thermosensitive recording layer comprising a reversible thermosensitive coloring composition, which utilizes a coloring reaction between an electron-donating coloring compound and an electron-accepting compound, will now be explained. The details of such a reversible thermosensitive recording layer are described in Japanese Laid-Open Patent Applications 4-224996, 4-247985 and 4-267190.

The reversible thermosensitive coloring composition, which utilizes a coloring reaction between an electron-donating coloring compound and an electron-accepting compound, forms an amorphous colored material when the electron-donating coloring compound and the electron-accepting compound are mixedly heated to a fusing temperature and fused by the application of heat thereto, and when the amorphous colored material is heated to a temperature lower than the above-mentioned fusing temperature, the electron-accepting compound in the amorphous colored material is crystallized so that the colored material is decolorized. The reversible thermosensitive recording layer comprising a reversible thermosensitive coloring composition utilizes the above-described reversible coloring and decolorizing phenomenon.

The above-mentioned electron-donating coloring compound and electron-accepting compound are respectively hereinafter referred to as the coloring agent and the color developer.

In the reversible thermosensitive coloring composition, the coloring agent and the color developer are indispensable components. When the coloring agent and the color developer are heated to a coloring temperature and fused, the reversible thermosensitive coloring composition assumes a colored state.

However, when the reversible thermosensitive coloring composition is then heated to a temperature lower than the above-mentioned coloring temperature, the colored state is changed to a decolorized state. These colored state and decolorized state can stably exist at room temperature. This reversible coloring and decolorizing phenomenon is based on the previously mentioned coloring and decolorizing mechanism.

In the case of a composition comprising a conventional coloring agent and a conventional color developer, for example, a leuco compound having a lactone ring which is a dye precursor, and a phenolic compound which is capable of inducing a color in the leuco compound, when the composition is heated to mix and fuse the leuco compound and the phenolic compound, the leuco compound assumes a colored state by the lactone ring being opened. In this colored state, the leuco compound and the phenolic compound are mutually dissolved to form an amorphous state. This colored amorphous state is stable at room temperature. However, even if this composition in the colored amorphous state is again heated, the phenolic compound is not crystallized and therefore is not separated from the leuco compound, so that the lactone ring formation does not occur and therefore the composition does not assume a decolorized state.

In the present invention, when the composition comprising the coloring agent and the color developer is heated to the coloring temperature to mix and fuse the coloring agent and the color developer, the composition assumes an amorphous colored state, which is stable at room temperature in the same manner as in the above-mentioned composition comprising the leuco compound and the phenolic compound. However, in the present invention, it is considered that when the composition in the amorphous colored state is heated to a temperature lower than the coloring temperature, at which the coloring agent and the color developer are not fused, the color developer is crystallized and separated from the coloring agent, breaking the bonding between the color developer and the coloring agent in the fused state, so that the coloring agent is decolorized since the color developer cannot accept electrons from the coloring agent.

In the reversible thermosensitive coloring composition for use in the present invention, the decolorization thereof is caused by the separation of the color developer from the coloring agent because of the crystallization of the color developer. In order to obtain a reversible thermosensitive coloring composition with excellent decolorization effect, the choice of a suitable color developer is extremely important.

Preferable examples of the color developer for use in the present invention are as follows, but the color developer for use in the present invention is not limited to these examples:

(1) Organic phosphoric acid compound of the following formula:

$$R_1—PO(OH)_2$$

wherein $R_1$ is a straight or branched alkyl or alkenyl group having 8 to 30 carbon atoms.

(2) Organic acid of the following formula, having a hydroxyl group at the s-position thereof:

$$R_2—CH(OH)COOH$$

wherein $R_2$ is a straight or branched alkyl or alkenyl group having 6 to 28 carbon atoms.

The coloring agent for use in the above is an electron-accepting compound which is a colorless or light-colored dye precursor. Examples of the coloring agent include triphenylmethane compounds, fluoran compounds, thenothiazine compounds, leuco auramine compounds, rhodaminelactam compounds, spiropyran compounds and indolinophthalide compounds, but the coloring agent for use in the present invention is not limited to these compounds.

The matrix resin for use in the reversible thermosensitive recording layer can be crosslinked by the application of heat, ultraviolet light radiation, or electron beam radiation. Of these crosslinking methods, electron beam radiation is the most suitable for crosslinking the matrix resin in the present invention.

More specifically the methods of crosslinking can be classified as follows:

(1) Method of performing the crosslinking by using a resin that can be crosslinked.

(2) Method of performing the crosslinking by use of a crosslinking agent.

(3) Method of performing the crosslinking by ultraviolet light radiation or electron beam radiation.

(4) Method of performing the crosslinking by ultraviolet light radiation or electron beam radiation in the presence of a cross-linking agent.

Examples of the cross-linking agent for use in electron beam radiation include the following non-functional monomers and functional monomers:

Specific examples of the non-functional monomer:
Methyl methacrylate (MMA),
Ethyl methacrylate (EMA),
n-Butyl methacrylate (BMA),
i-Butyl methacrylate (IBMA),
t-Butyl methacrylate (TBMA),
2-Ethylhexyl methacrylate (EHMA),
Lauryl methacrylate (LMA),
Alkyl methacrylate (SLMA),
Tridecyl methacrlate (TDMA),
Stearyl methacrylate (SMA),
Cyclohexyl methacrylate (CHMA), and
Benzyl methacrylate (BZMA).

Specific examples of mono-functional monomers:
Methacrylic acid (MMA),
2-Hydroxyethyl methacrylate (HEMA),
2-Hydroxypropyl methacrylate (HPMA),
Dimethylaminoethyl methacrylate (DMMA),
Dimethylaminoethyl methylchloride salt methacrylate (DMCMA),
Diethylaminoethyl methacrylate (DEMA),
Glycidyl methacrylate (GMA),
Tetrahydrofurfuryl methacrylate (THFMA),
Allyl methacrylate (AMA),
Ethylene glycol dimethacrylate (EDMA),
Triethylene glycol dimethacrylate (3EDMA),
Tetraethylene glycol dimethacrylate (4EDMA),
1,3-Butylene glycol dimethacrylate (BDMA),
1,6-Hexanediol dimethacrylate (HXMA),
Trimethylolpropane trimethacrylate (TMPMA),
2-Ethoxyethyl methacrylate (ETMA),
2-Ethylhexyl acrylate,
Phenoxyethyl acrylate,
2-Ethoxyethyl acrylate,
2-Ethoxyethoxyethyl acrylate,
2-Hydroxyethyl acrylate,
2-Hydroxypropyl acrylate,
Dicyclopentenyloxy ethyl acrylate,
N-Vinyl pyrrolidone, and
Vinyl acetate.

Specific examples of di-functional monomer:

1,4-Butanediol acrylate,
1,6-Hexanediol diacrylate,
1,9-Nonanediol diacrylate,
Neopentyl glycol diacrylate,
Tetraethylene glycol diacrylate,
Tripropylene glycol diacrylate,
Tripropylene glycol diacrylate,
Polypropylene glycol diacrylate,
Bisphenol A. EO adduct diacrylate,
Glycerin methacrylate acrylate,
Diacrylate with 2-mole adduct of propylene oxide of neopentyl glycol,
Diethylene glycol diacrylate,
Polyethylene glycol (400) diacrylate,
Diacrylate of the ester of hydroxypivalic acid and neopentyl glycol,
2,2-Bis(4-acryloxy.diethoxyphenyl)propane,
Diacrylate of neopentyl glycol adipate,

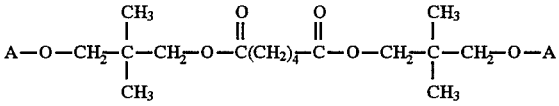

wherein A is $CH_2{=}CH\overset{O}{\overset{\|}{C}}-$ (acryloyl group)

Diacrylate of ∈-caprolactone adduct of neopentyl glycol hydroxypivalate

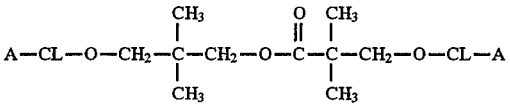

wherein CL is $-O(CH_2)_5\overset{O}{\overset{\|}{C}}-$ (∈-caprolactone)

Diacrylate of ∈-caprolactone adduct of neopentyl glycol hydroxypivalate,

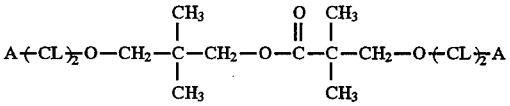

2-(2-hydroxy-1,1-dimethylethyl)-5-hydroxymethyl-5-ethyl-1,3-dioxanediacrylate

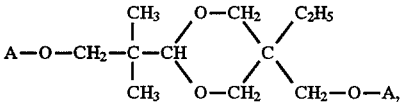

Tricyclodecanedimethylol diacrylate

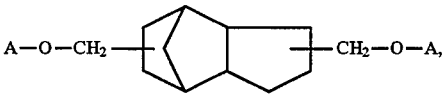

∈-Caprolactone adduct of tricyclodecanedimethylol diacrylate

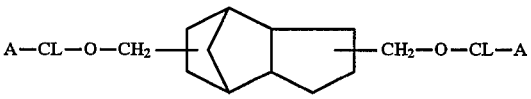

-continued

Diacrylate of diglycidynyl ether of 1,6-hexanediol,

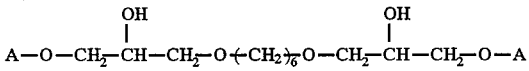

Specific examples of polyfunctional monomer:

Trimethylolpropane triacrylate,
Pentaerythritol triacrylate,
Glycerine PO-adduct triacrylate,

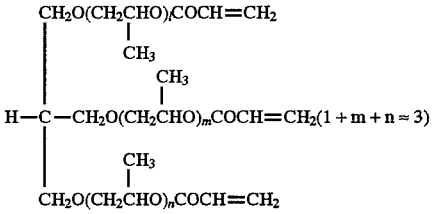

Trisacryloyloxyethyl phosphate,
Pentaerythritol tetracrylate,
Triacrylate with 3-mole adduct of propylene oxide of trimethylol propane,
Glycerylpropoxy triacrylate,
Dipentaerythritol.polyacrylate
Polyacrylate of caprolactone adduct of dipentaerythritol,
Propionic acid.dipentaerythritol triacrylate,
Hydroxypivalaldehyde-modified dimethylolpropine triacrylate,

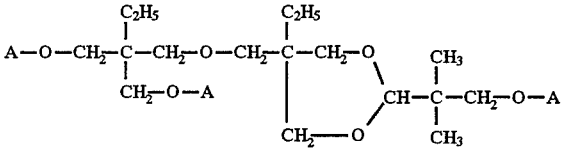

Tetraacrylate of propionic acid.dipentaerythritol,

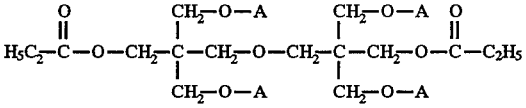

Ditrimethylolpropane tetracrylate,
Pentaacrylate of dipentaerythritol propionate,
Dipentaerythritol hexacrylate (DPHA)
∈-caprolactone adduct of DPHA,

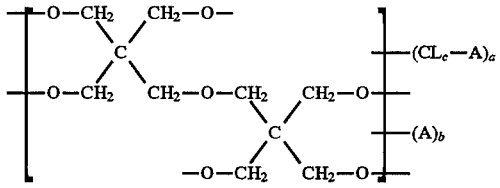

(DPCA-20)
a = 2, b = 4, c = 1
(DPCA-30)
a = 3, b = 3, c = 1
(DPCA-60)
a = 6, c = 1
(DPCA-120)
a = 6, c = 2

An example of oligomer:

Bisphenol A - diepoxyacrylic acid adduct,

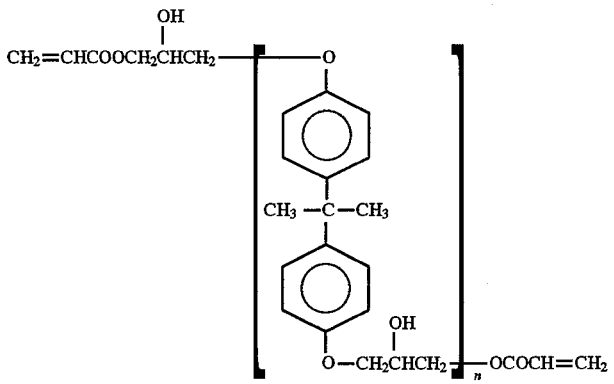

(n ≈1, 2)

These crosslinking agents can be used alone or in combination. It is preferable that the amount of such a crosslinking agent to be added be in the range of 0.001 to 1.0 parts by weight, more preferably in the range of 0.01 to 0.5 parts by weight, to 1 part by weight of the matrix resin. This is because there is the tendency that when the amount of the cross-linking agent is less than 0.001 parts by weight to 1 part by weight of the matrix resin, the crosslinking effect becomes insufficient, while when the amount of the cross-linking agent exceeds 1.0 part by weight, the milky white opaqueness of the reversible thermosensitive recording layer decreases and therefore image contrast decreases.

In order to increase the crosslinking efficiency by minimizing the amount of such a cross-linking agent added, the functional monomers are better than non-functional monomers, and the polyfunctional monomers are better than the monofunctional monomers.

When the above crosslinking is performed by ultraviolet radiation, the following cross-linking agents, photopolymerization initiators and photopolymerization promoters can be employed, although the cross-linking agents, photopolymerization initiators and photopolymerization promoters for use in the present invention are not limited to them.

More specifically, the cross-linking agents for use in the ultraviolet radiation can be roughly classified into photopolymerizable prepolymers and photopolymerizable monomers.

As the photopoymerizable monomers, the previously mentioned mono-functional monomers and polyfunctional monomers for use in the electron beam radiation can be employed.

As the photopolymerizable prepolymers, for instance, polyester acrylate, polyurethane acrylate, polyether acrylate, oligoacrylate, alkyd acylate, and polyol acrylate can be employed.

These crosslinking agents can be used alone or in combination. It is preferable that the amount of such a crosslinking agent to be added be in the range of 0.001 to 1.0 parts by weight, more preferably in the range of 0.01 to 0.5 parts by weight, to 1 part by weight of the matrix resin. This is because there is the tendency that when the amount of the cross-linking agent is less than 0.001 parts by weight to 1 part by weight of the matrix resin, the crosslinking effect becomes insufficient, while when the amount of the cross-linking agent exceeds 1.0 part by weight, the milky white opaqueness of the reversible thermosensitive recording layer decreases and therefore image contrast decreases.

The photopolymerization initiators can be roughly classified into radical reaction type initiators and ionic reaction type initiators. The radical reaction type initiators can be further classified into photo-cleavage type initiators and hydrogen-pulling type initiators.

Specific examples of initiators for use in the present invention are as follows:

1. Benzoin ethers
Isobutyl benzoin ether

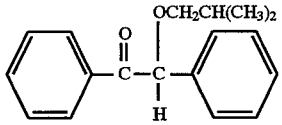

Isopropyl benzoin ether

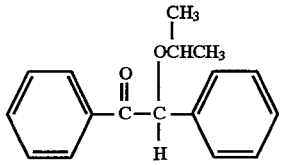

Benzoin ethyl ether

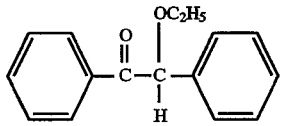

Benzoin methyl ether

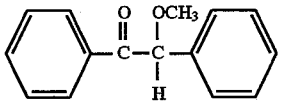

2. α-Acyloxime ester
1-phenyl-1,2-propanedion-2-(o-ethoxy-carbonyl)oxime

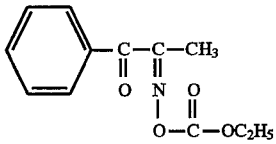

3. Benzyl ketals
2,2-Dimethoxy-2-phenyl-acetophenone

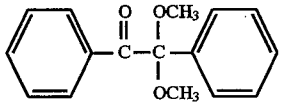

-continued

4. Acetophenone derivatives Diethoxy acetophenone

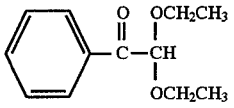

2-Hydroxy-2-methyl-1.phenyl-propane-1-on

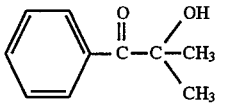

5. Benzophenone derivatives Benzophenone

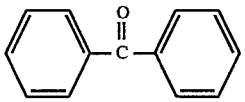

Chlorine-substituted benzophenone

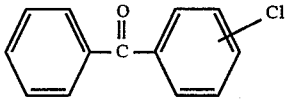

6. Xanthone derivatives Chloro-thioxanthone

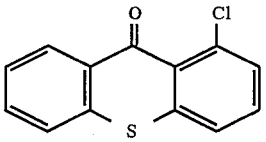

2-Chloro-thioxanthone

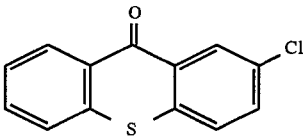

Isopropyl thioxanthone

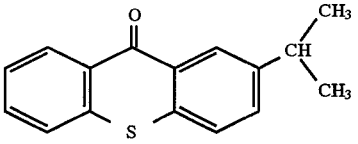

2-Methyl thioxanthone

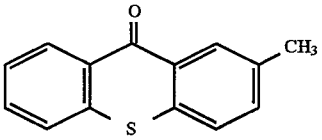

Benzyl

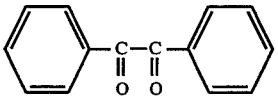

Hydroxy-cyclohexyl phenyl ketone

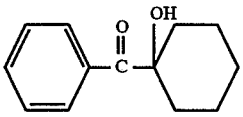

These photopolymerization initiators can be used alone or in combination. It is preferable to employ such an initiator in an amount in the range of 0.005 to 1.0 parts by weight, more preferably in the range of 0.01 to 0.5 parts by weight, to 1 part of any of the previously mentioned cross-linking agents.

Photopolymerization promoters have a hardening-rate-increasing effect on the hydrogen-pulling type photopolymerization initiators such as benzophenone type and thioxanthone type initiators. There are aromatic tertiary amine type photopolymerization promotors and aliphatic amine type photopolymerization promotors.

Specific examples of such photopolymerization initiators are as follows:

Isoamyl p-dimethylaminobenzoate

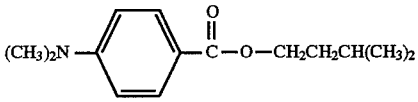

Ethyl p-dimetylaminobenzoate

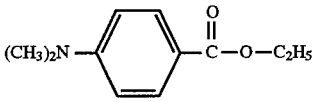

These photopolymerization promotors can be used alone or in combination. It is preferable to employ such a photopolymerization promotor in an amount of 0.1 to 5 parts by weight, more preferably in an amount of 0.3 to 3 parts by weight, to 1 part by weight of a photopolymerization initiator.

An ultraviolet light radiation apparatus for use in the present invention is composed of a light source, a radiation unit, a power source, a cooling unit, and a transportation unit. As the light source, a mercury lamp, a metal halide lamp, a gallium lamp, a mercury xenon lamp, or a flush lamp may be employed. However any light source can be employed as long as it has a light emitting spectrum corresponding to the ultraviolet absorption wavelength for the previously mentioned photopolymerization initiators and photopolymerization promotors.

As to the conditions for ultraviolet light radiation, the lamp output and transportation speed may be determined in accordance with the radiation energy necessary for crosslinking the resin to be crosslinked.

In the present invention, the following is a particularly effective electron beam radiation method for crosslinking the resin in the reversible thermosensitive recording layer of the reversible thermosensitive recording medium of the present invention.

Generally EB (electron beam) radiation apparatus can be classified into a scan beam EB radiation apparatus and an area beam EB radiation apparatus. An appropriate EB radiation apparatus is chosen in accordance with the desired radiation area, exposure and other factors. The EB radiation conditions can be determined by the following formula in accordance with the necessary exposure of the resin to be crosslinked to electron beam, with the current, radiation width and transportation speed being taken into consideration:

$$D=(\Delta E/\Delta R)\cdot\eta\cdot I/(W\cdot V)$$

where

D: Necessary exposure to electron beam (Mrad)

ΔE/ΔR: Average energy loss

η: Efficiency

I: Current (mA)

W: Radiation width (cm)

V: Transportation speed (cm/s)

For industrial purpose, the above formula is simplified as D·V=K·I/W, and the apparatus rating is indicated by Mrad·m/min.

The current rating is selected in such a manner that about 20 to 30 mA is for an experimental apparatus, about 50 to 100 mA is for a pilot apparatus and about 100 to 500 mA is for an industrial apparatus.

As to the necessary exposure of the resin to electron beam for crosslinking the resin, the crosslinking efficiency varies in accordance with the kind of a resin to be crosslinked, the polymerization degree thereof, the kind of the crosslinking agent employed, the amount thereof, the kind of the plasticizer employed, the amount thereof and other factors, so that the gel percentage of the resin is not always constant for a constant exposure to electron beam. Therefore, a reversible thermosensitive recording layer of a reversible thermosensitive recording medium is fabricated in accordance with the levels for the constituent factors therefor, and the desired gel percentage is determined. Thus the necessary exposure to electron beam is then determined in accordance with the desired gel percentage.

In the case where high energy is required for crosslinking the resin, it is preferable that the radiation of electron beam to the resin be separately performed a plurality of times in order to avoid the deformation or thermal decomposition of the resin or the support for the reversible thermosensitive recording medium by the heat generated by the application of electron beam with high energy.

It is preferable that prior to the crosslinking of the resin by electron beam radiation, the resin in the reversible thermosensitive recording layer be heated to a temperature at which at least part of the organic low-molecular-weight material contained in the recording layer be melted or the organic low-molecular-weight material be melted in its entirety.

The relationship between the constituent factors for the reversible thermosensitive recording layer and the gel percentage of the resin is as follows:

As the resin for the reversible thermosensitive recording layer, any of the previously mentioned resins can be employed. However, there is the tendency that the gel percentage is increased as the polymerization degree (P) of the resin is increased. Therefore it is preferable that the polymerization degree (P) be 300 or more, more preferably 600 or more.

As to the kinds of cross-linking agent that can be employed in the present invention and the amount thereof to be employed have been described previously. As the plasticizer for use in the reversible thermosensitive recording layer, fatty acid ester, polyester plasticizers, and epoxy plasticizers are preferable. Of these plasticizers, epoxy plasticizers are particularly preferable for use in the present invention. As to the amount of such a plasticizer to be added, there is the tendency that the gel percentage is increased as the amount of the plasticizer added is increased. Therefore it is preferable that such a plasticizer be added in an amount of 0.01 to 1.0 parts by weight, more preferably in an amount of 0.05 to 0.5 parts by weight, to 1 part by weight of the resin.

In order to improve the repeated use durability of the reversible thermosensitive recording layer, there are the following methods.

In the first method, the softening point of the reversible thermosensitive recording layer is increased, whereby the repeated use durability of the reversible thermosensitive recording layer is increased.

The softening point of the reversible thermosensitive recording layer can be measured by use of the same film layer as that employed for the measurement of the gel percentage and a thermal mechanical analyzer (TMA) and a dynamic elastoviscosimeter.

Furthermore, the softening point can be measured by a dynamic elastoviscosimeter which employs a rigid pendulum without peeling off the reversible thermosensitive recording layer. The smaller the changes in the softening point of the reversible thermosensitive recording layer with time, the smaller the changes in the transparent temperature range of the reversible thermosensitive recording layer.

In the second method, a protective layer is formed on the reversible thermosensitive recording layer which is provided on a support, and the adhesive strength between the reversible thermosensitive recording layer and the protective layer is intensified, whereby the repeated use durability of the reversible thermosensitive recording layer can be improved. The adhesive strength between the two layers can be measured in accordance with the method of Tappi UM-403.

In the third method, the repeated use durability of the reversible thermosensitive recording layer can be improved by improving the penetration of a loaded needle into the recording layer in accordance with the penetration measurement method using the TMA (thermal mechanical analyzer). The measurement of the penetration is performed to the reversible thermosensitive recording layer by use of the TMA employed for the measurement of the softening point by causing a loaded needle to penetrate into the recording layer and measuring the displacement of the loaded needle, with the application of heat to the recording layer when necessary.

In the fourth method, the repeated use durability of the reversible thermosensitive recording layer can be improved by minimizing the amount of the cross-linking agent which remains in the recording layer. The amount of the cross-linking agent which remains in the reversible thermosensitive recording layer can be measured by the following method:

As the apparatus for the measurement of the amount of the cross-linking agent, an ATR (Attenuated Total Reflection) measurement accessory apparatus which is attached to a Fourier transformation infrared spectrophotometer is employed. As the test sample, the same recording layer coated film as that employed in the above-mentioned gel percentage is employed. After the exposure of the sample to electron beam, the intensity of the absorption band due to the CH-out-of-plane vibrations of the acryloyl group, which appears near 810 $cm^{-1}$, is measured. The intensity of this absorption band is proportional to the amount of the remaining cross-linking agent in the recording layer, so that the amount of the remaining cross-linking agent in the recording layer can be measured by measuring the intensity of the above-mentioned absorption band.

It is preferable that the amount of the remaining cross-linking agent in the reversible thermosensitive recording layer be in the range of 0.2 parts by weight or less, more preferably in the range of 0.1 parts by weight or less, further more preferably in the range of 0.05 parts by weight, most preferably in the range of 0.01 parts by weight, to 1 part by weight of the resin in the reversible thermosensitive recording layer.

By use of the above-mentioned method, the remaining amount of the photopolymerization initiator and/or photopolymerization promotor in the reversible thermosensitive recording layer, which are employed by UV cross-linking, and the remaining amount of catalysts and the like employed in thermal crosslinking can also be measured.

Furthermore, by the qualitative analysis of such components remaining in the reversible thermosensitive recording layer, the method of the crosslinking of the recording layer, that is, EB crosslinking, UV crosslinking or thermal crosslinking, can be identified.

In any of the crosslinking methods, the smaller the amount of such components remaining in the reversible thermosensitive recording layer, the higher the repeated use durability of the reversible thermosensitive recording layer.

The above-mentioned method is applied to only a thin surface coated layer with a thickness in the order of several μm. However the measurement can also be applied to the recording layer formed on a support, without the recording layer being peeled off the support.

In the case where there are vacant gaps with a refractive index which is different from the refractive indexes of the matrix resin and the organic low-molecular-weight material at the interfaces between the matrix resin and the particles of the organic low-molecular-weight material and/or within the particles of the organic low-molecular-weight material in the reversible thermosensitive recording layer, the image density in the milky white state is improved and accordingly the image contrast is also improved. This effect is significant when the size of such vacant gaps be 1/10 or more the wavelength of the light for detecting the milky white opaque state.

In the case where images formed in this reversible thermosensitive recording medium are used as reflection images, it is preferable to place a light reflection layer behind the reversible thermosensitive recording layer of the recording medium. When such a light reflection layer is provided, the image contrast can be increased even when the reversible thermosensitive recording layer is thin. Examples of such a light reflection layer made by vacuum deposition of Al, Ni, Sn or the like are disclosed in Japanese Laid-Open Patent Application 64-14079.

As mentioned previously, a protective layer may be provided on the reversible thermosensitive recording layer. Examples of the material for such a protective layer having a thickness of 0.1 to 10 μm are silicone rubber and silicone resin as disclosed in Japanese Laid-Open Patent Application 63-221087, polysiloxane graft polymer as disclosed in Japanese Patent Application 62-152550, and ultraviolet curing resin and electron beam curing resin as disclosed in Japanese Patent Application 63-310600.

When a protective layer is formed by use of any of the above-mentioned materials, a solvent is used for coating the protective layer. It is preferable that the solvent for use this object be such a solvent that the resin for the reversible thermosensitive recording layer and the organic low-molecular-weight material are not soluble or slightly soluble in the solvent.

Specific examples of such a solvent include n-hexane, methyl alcohol, ethyl alcohol, and isopropyl alcohol. In view of the cost, alcohol solvents are preferable.

It is possible to cure the protective layer simultaneously with the crosslinking of the matrix resin in the reversible thermosensitive recording layer. In this case, the reversible thermosensitive recording layer is formed on a support by the previously mentioned method, and a protective layer formation liquid is coated on the recording layer and dried. Thereafter, the coated protective layer and the recording layer are both cured by being subjected to electron beam by the previously mentioned electron beam radiation apparatus under the previously mentioned conditions, or to ultraviolet light by the previously mentioned ultraviolet light radiation apparatus under the previously mentioned conditions.

In order to protect the reversible thermosensitive recording layer from the solvent and/or monomer which is employed for the formation of the protective layer, an intermediate layer may be interposed between the protective layer and the reversible thermosensitive recording layer as disclosed in Japanese Laid-Open Patent Application 1-133781. As the material for the intermediate layer, the same materials as those for the matrix resin for the reversible thermosensitive recording layer can be employed. In addition to those materials, the following thermosetting resins and thermoplastic resins can be employed. Specific examples of such resins are polyethylene, polypropylene, polystyrene, polyvinyl alcohol, polyvinyl butyral, polyurethane, saturated polyester, unsaturated polyester, epoxy resin, phenolic resin, polycarbonate, and polyamide.

It is preferable that the intermediate layer have aa thickness in the range of 0.1 to 2 μm.

In order to make the images formed in the reversible thermosensitive layer clear and more easily visible, a colored layer may be interposed between the support and the recording layer.

Such a colored layer can be formed by coating a solution or dispersion of a coloring agent and a binder resin to the surface to be coated therewith, drying the coated solution or dispersion. Alternatively, the colored layer may be formed by applying a colored sheet to the subject surface.

As the coloring agent for use in the colored layer, any dyes and pigments can be employed as long as the transparent and milky white images formed on the recording layer which is situated above the colored layer can be made recognizable as reflection images, so that dyes and pigments with colors such as red, yellow, blue, dark blue, purple, black, brown, grey, orange and green can be employed.

As the binder resin for the colored layer, varieties of thermoplastic resins, thermosetting resins and ultraviolet-curing resins can be employed.

An air layer which constitutes a non-contact portion can be interposed between the support and the reversible thermosensitive recording layer.

When such an air layer is interposed between the support and the recording layer, a large difference in the refractive index is formed between the recording layer and the air layer because the refractive indexes of the organic polymeric materials for the recording layer are in the range of about 1.4 to 1.6, while the refractive index of the air in the air layer is 1.0.

Therefore, light is reflected at the interface between the surface of the support on the side of the recording layer and the air layer which constitutes the non-contact portion, so that when the recording layer is in the milky white state, the milky white opaqueness is intensified, and therefore the images can be made more easily visible. Therefore it is preferable that such a non-contact portion be employed as a display portion of the reversible thermosensitive recording medium.

The non-contact portion contains air therein, so that the non-contact portion serves as a heat insulating layer. Therefore the thermosensitivity of the recording layer on the non-contact portion is improved.

The non-contact portion also serves as a cushion, so that even when a thermal head is brought into pressure contact with the recording layer, the pressure actually applied to the recording layer is reduced and the deformation of the recording layer, if any, is minimal. Therefore, the particles of the organic low-molecular-weight material are not depressed flat or deformed. Thus, the repeated use durability of the reversible thermosensitive recording layer is improved.

Furthermore, it is also possible to apply an adhesive layer to the back side of the support opposite to the recording layer of the reversible thermosensitive recording medium in order to use the reversible thermosensitive recording medium as a reversible thermosensitive recording label sheet. Such a reversible thermosensitive recording label sheet can be applied to a base sheet or plate. Examples of such a base sheet or plate are polyvinyl chloride cards for credit cards, IC cards, ID cards, paper, film, synthetic paper, boarding pass, and commuter's pass. The above-mentioned base sheet or plate are not limited to these sheets or cards.

In the case where the support is, for example, an aluminum-deposited layer which has poor adhesiveness to a resin, an adhesive layer may be interposed between the support and the reversible thermosensitive recording layer as disclosed in Japanese Laid-Open Patent Application 3-7377.

When the reversible thermosensitive recording medium of the present invention is employed in a thermosensitive recording image display apparatus for displaying images, there are varieties of thermosensitive recording image display apparatus.

One of the representative thermosensitive recording image display apparatus comprises one heat heating element which serves as image formation means for forming images in the reversible thermosensitive recording medium and also as image erasing means for erasing recorded images from the recording medium. As such an image formation means, for example, a thermal head can be employed by changing the energy applied thereto when it is used as image formation means and when it is used as image erasing means.

Another representative thermosensitive recording image display apparatus comprises a thermal head for forming images, and a pressure contact type heating means for erasing images by which a heating element such as a thermal head, a hot stamp, a heat roller, or a heat block, is brought into pressure contact with the surface of the reversible thermosensitive recording layer, thereby erasing images formed thereon.

A further representative thermosensitive recording image display apparatus comprises a thermal head for forming images, and a non-contact type heating means for erasing images, such as a means for applying hot air or infrared.

More specifically, FIG. 8(*a*) schematically shows a thermosensitive recording image display apparatus of a pressure contact type. In this apparatus, a hot stamp 102 is brought into pressure contact with a reversible thermosensitive recording medium 1 which is placed on a stamp stand 103, whereby a heated portion of the reversible thermosensitive layer is made transparent.

FIG. 8(*b*) schematically shows another thermosensitive recording image display apparatus of a pressure contact type. In this apparatus, the reversible thermosensitive recording medium 1 is held between a heat roller 104 and an idle roller 105, which are rotated at the same peripheral speed, and transported in the direction of the arrow. Thus, the reversible thermosensitive recording medium 101 is made transparent in contact with the heat roller 104.

FIG. 8(*c*) schematically shows a thermosensitive recording image display apparatus of a non-contact type. In this apparatus, the reversible thermosensitive recording medium 1 is made transparent by the hot air from a dryer 106. Reference numeral 107 indicates a feed roller for transporting the reversible thermosensitive recording medium 1.

FIG. 8(*d*) schematically shows a further thermosensitive recording image display apparatus of a pressure contact type. In this apparatus, a heat block 108 is brought into pressure contact with the reversible thermosensitive recording medium 1 which is transported in the direction of the arrow by the feed roller 107. In this apparatus, a thermal head (not shown) may be employed as image erasing means.

A specific example of the image formation and image erasure in the reversible thermosensitive recording medium of the present invention by use of a thermosensitive image recording and display apparatus will now be explained with reference to FIGS. 9(*a*) and 9(*b*).

Figure 9A:
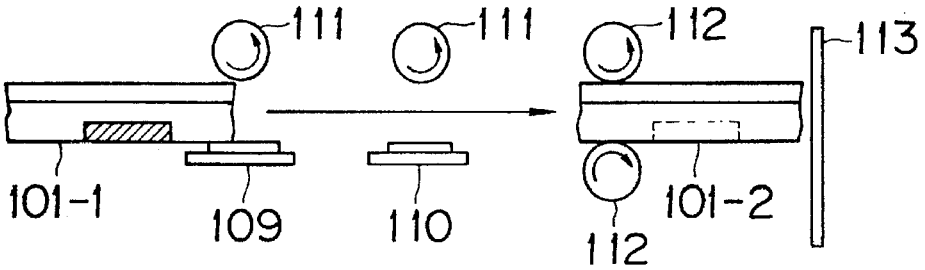
FIG. 9(*a*) and FIG. 9(*b*) schematically show a thermosensitive recording and image formation apparatus.
Figure 9B:
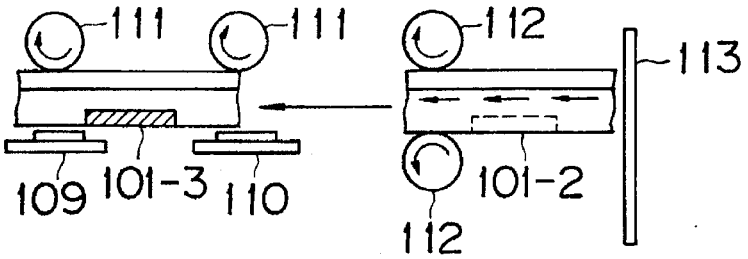

FIG. 9(*a*) shows the case where thermal heads are used as image formation means and image erasing means. More specifically, a reversible thermosensitive recording medium 101-1 bears an image thereon shown by the shaded area as shown in FIG. 9(*a*). The reversible thermosensitive recording medium 101-1 is transported in the direction of the arrow by a platen roller 111. During the transportation step, thermal energy is applied to the reversible thermosensitive recording medium 101-1 by a thermal head 109 for image erasure, so that the image formed in the reversible thermosensitive recording medium 101-1 is erased. During this step, strain stress is generated at the contact surface of the thermal head 109 with the surface of the recording medium 101-1. However, since the resin in the recording layer is crosslinked, the generated strain stress is extremely small.

Thereafter the recording medium 101-1 is further transported in the direction of the arrow by the platen roller 111, without energy being applied thereto by a thermal head 110 for image formation. The recording medium 101-1 is further transported up to a stopper 113 by guide rollers 112. The recording medium 101-1 from which the image has been erased is referred to as the recording medium 101-2.

In FIG. 9(*b*), the recording medium 101-2 which bears no image therein is then transported in the direction of the arrow by the guide rollers 112. The recording medium 101-2 is then further transported in the direction of the arrow by the platen roller 111. During this transportation step, energy is applied to the recording medium 101-2 by the thermal head 110 for image formation, so that a new image as indicated by the shaded area is formed in the recording medium 101-2. The recording medium which bears the new image is referred to as the recording medium 101-3. During this step, strain stress is also generated at the contact surface of the thermal head 109 with the surface of the recording medium. However, for the same reason as mentioned above, the generated strain stress is extremely small. The recording medium 101-3 is further transported in the direction of the arrow by the platen roller 111, but without energy being applied to the recording medium 101-3 by the thermal head 109 for image erasure.

By use of the above-mentioned thermosensitive recording and image formation apparatus and the reversible thermosensitive recording medium, image display can be carried out.

In the thermosensitive recording and image formation apparatus shown in FIG. 9(*a*) and FIG. 9(*b*), one and the same thermal head can be used as the thermal heads 109 and 110. Furthermore, the thermal head 109 for image erasure can be replaced with a contact type image erasure unit such as a hot stamp, a heat roller, or a heat block, or with a non-contact type image erasure unit such as a hot-air or infrared emitting unit. Furthermore, in the thermosensitive recording and image formation apparatus shown in FIG. 9(*a*) and FIG. 9(*b*), the thermal head 109 is for image erasure, while the thermal head 110 is for image formation. However, the these thermal heads can be reversed with respect to the application, that is, the thermal head 109 may be used for image formation, and the thermal head 110 may be used for image erasure.

Figure 10:
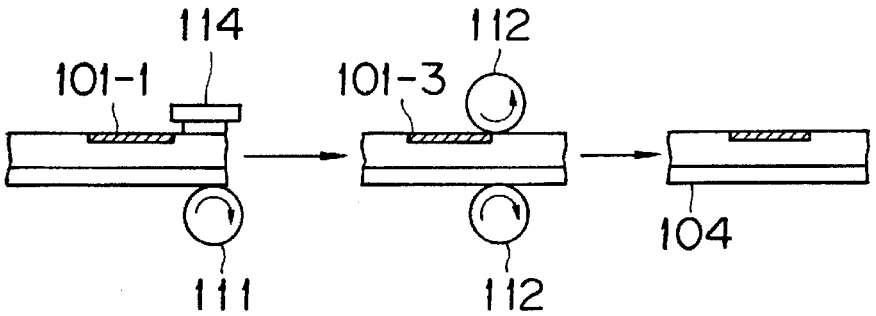
FIG. 10 schematically shows a thermosensitive recording and image formation apparatus in which a single thermal head is used as both image formation means and image erasing means.
Figure 11A:
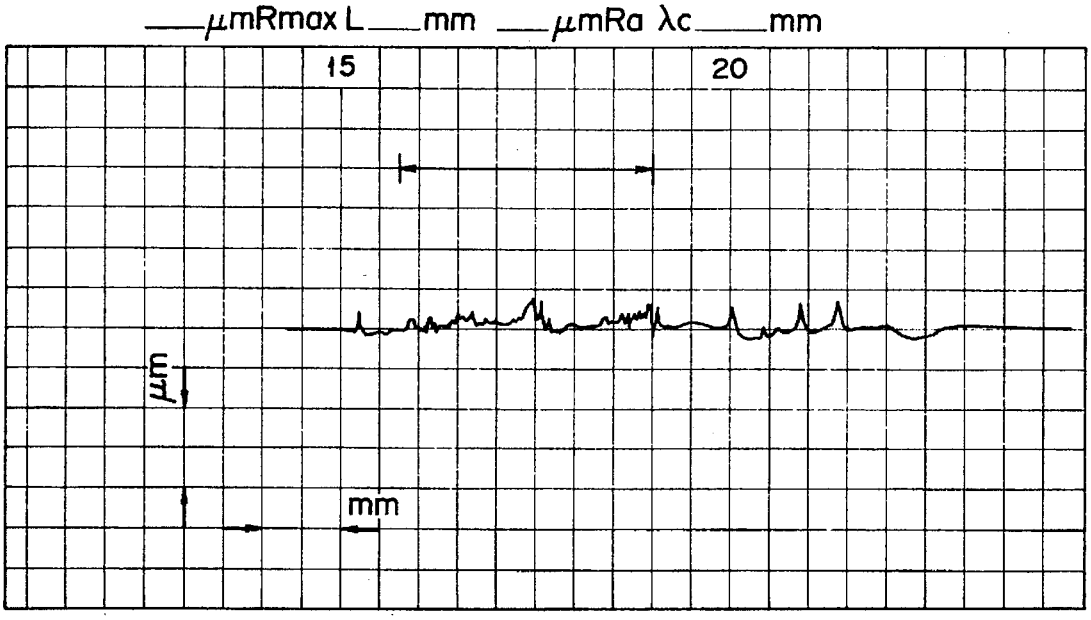
FIG. 11(*a*) shows the surface roughness of the reversible thermosensitive recording medium No. 7 prepared in Example 7, which was obtained when the initial thermal pressure level difference thereof was measured.
Figure 11B:
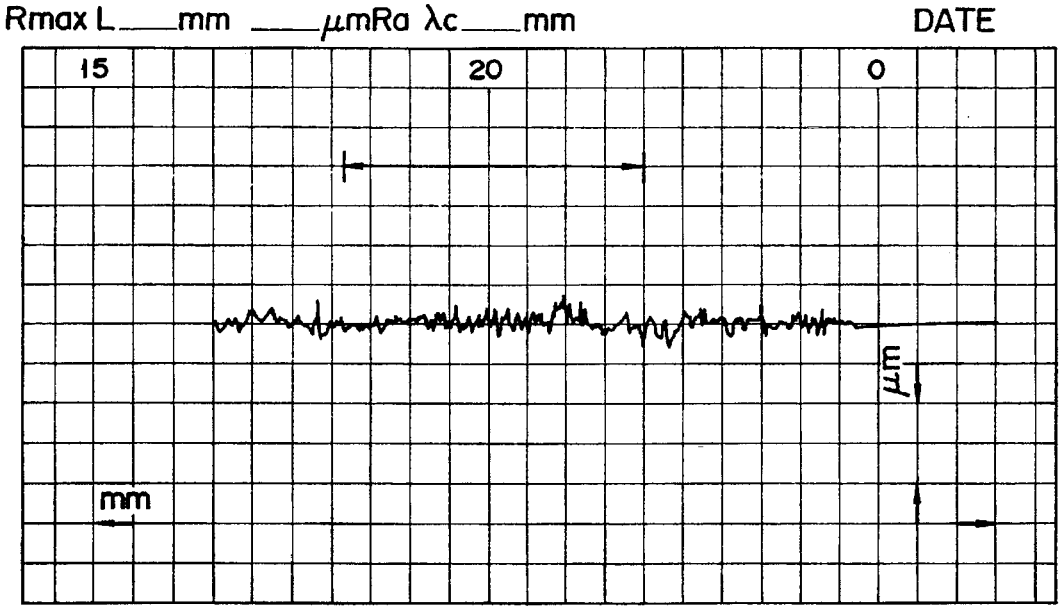
Figure 11C:
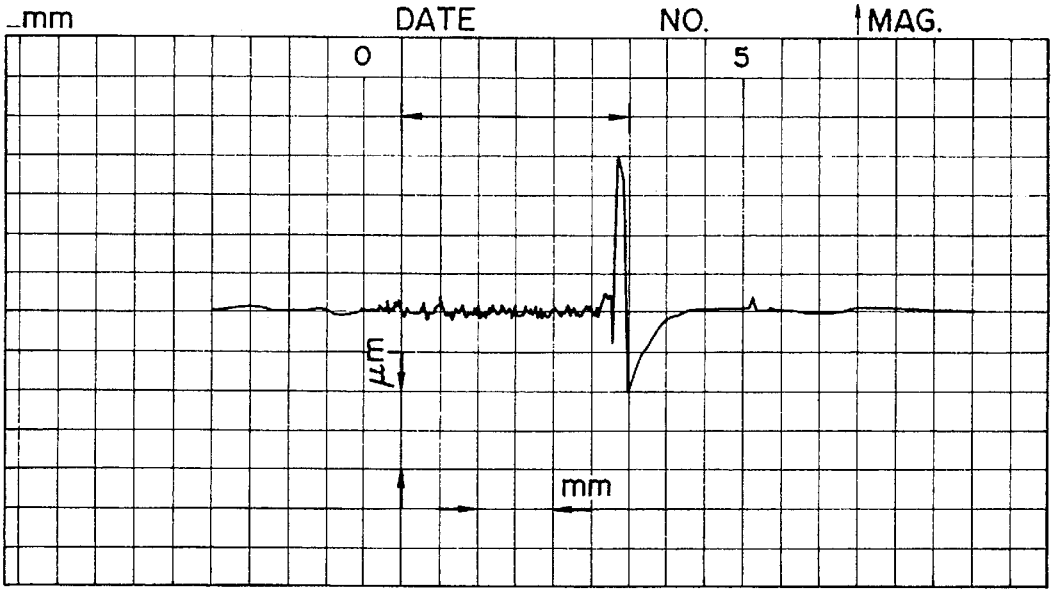
Figure 11D:
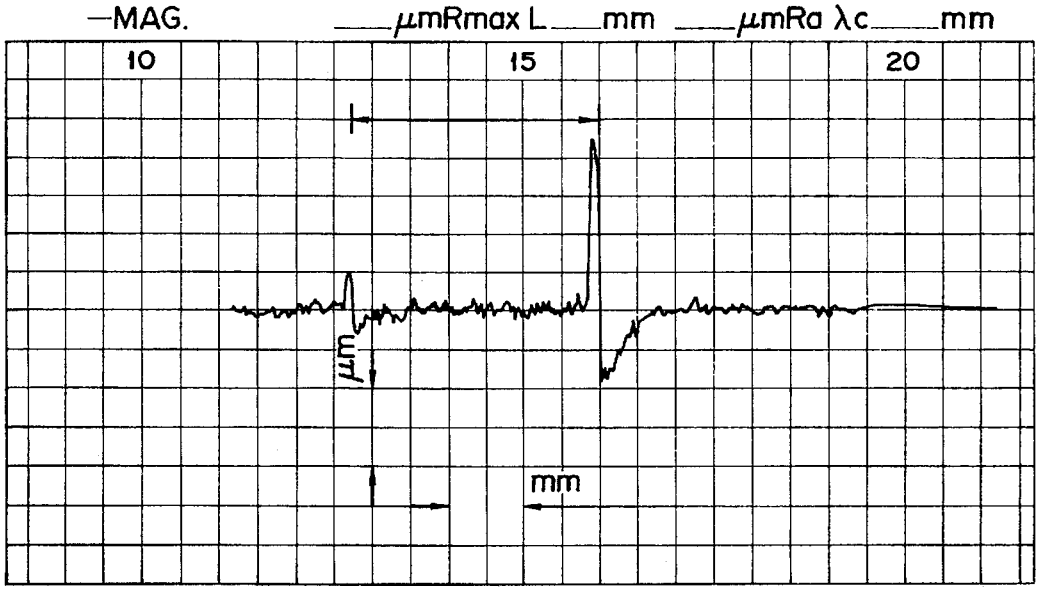

FIG. 10 shows a thermosensitive recording and image formation apparatus in which a single thermal head is used as both image formation means and image erasing means, and a guide roller which serves as pressure application means is provided behind the thermal head.

More specifically, a reversible thermosensitive recording medium 101-1 which bears an image formed therein is transported in the direction of the arrow by a platen roller 111. During this transportation step, the old image is erased and a new image is formed by a thermal head 114 for both image formation and image erasure. The reversible thermosensitive recording medium 101-3 which bears the new image thereon is further transported in the direction of the arrow by the platen roller 111, passing between the guide rollers 112, so that a reversible thermosensitive recording medium 101-4 is formed.

Thus, the thermosensitive recording and image formation apparatus as shown in FIG. 10 is also capable of displaying images. The image formation and image erasure can be performed by non-contact energy application. Furthermore, means for heating the recording medium to a temperature above the image formation temperature and means for heating the recording medium to a temperature above the image formation temperature with the application of pressure thereto can also be provided between the steps of image formation and image erasure.

Since the reversible thermosensitive recording layer of the reversible thermosensitive recording medium of the present invention has a cross-linked structure in its entirety, no distortion takes place in the recording layer and the particles of the organic low-molecular-weight material contained in the recording layer, so that excellent image recording and erasure can be always performed. Furthermore, by crosslinking the matrix resin in the recording layer, problems such as the shifting of the colors developed in the recording layer can be avoided.

The features of this invention will become apparent in the course of the following description of exemplary embodiments, which are given for illustration of the invention and are not intended to be limiting thereof.

EXAMPLE 1

[Preparation of Reversible Thermosensitive Recording Medium No. 1]

A light reflection layer with a thickness of about 400 Å was provided by vacuum deposition of aluminum on a polyester film with a thickness of about 188 μm.

The thus provided light reflection layer was then coated with a coating liquid for the formation of an adhesive layer with the following formulation, and the coated liquid was dried with the application of heat thereto, whereby an adhesive layer with a thickness of about 0.5 μm was formed on the light reflection layer:

| | Parts by Weight |
|---|---|
| Vinyl chloride - vinyl acetate-phosphoric ester copolymer (Trademark "Denka Vinyl #1000P" made by Denki Kagaku Kogyo Kabushiki Kaisha) | 5 |
| THF | 95 |

A coating liquid for the formation of a reversible thermosensitive recording layer with the following formulation was coated on the adhesive layer, dried at 130° C. for 3 minutes, whereby a reversible thermosensitive recording layer with a thickness of about 15 μm was formed on the adhesive layer:

| | Parts by Weight |
|---|---|
| Behenic acid (Trademark "NAA-22S" made by Nippon Oils & Fats Co., Ltd.) | 5 |
| Eicosanedioic acid (Trademark "SL-20-99" made by Okamura Oil Mill Ltd.) | 5 |
| Trimethylolpropane triacrylate (Trademark "TMP3A" made by Osaka Organic Chemical Industry Ltd.) | 1.25 |
| Vinyl chloride - vinyl acetate copolymer (Trademark "No. 20-1497", vinyl chloride (80%) and vinyl acetate (20%), average degree of polymerization = 500, made by Kanegafuchi Chemical Industry Co., Ltd.) | 25 |
| THF | 150 |
| Toluene | 15 |

The above formed reversible thermosensitive recording layer was subjected to electron beam radiation by use of a commercially available area beam type electron beam radiation apparatus (Trademark "EBC-200-AA2" made by Nisshin High Voltage Co., Ltd.) under the conditions that the electron beam exposure was 15 Mrad.

A coating liquid for the formation of a protective layer with the following formulation was coated on the reversible thermosensitive recording layer by a wire bar, dried under the application of heat thereto, and cured by ultraviolet light by use of an 80 W/cm ultraviolet lamp, whereby a protective layer with a thickness of about 2 μm was formed on the reversible thermosensitive recording layer.

| | Parts by Weight |
|---|---|
| 75% solution of butyl acetate of urethaneacrylate type ultraviolet-curing resin (Trademark "Unidic C7-157" made by Dainippon Ink & Chemicals, Incorporated) | 10 |
| IPA | 10 |

Thus, a reversible thermosensitive recording medium No. 1 of the present invention was fabricated.

EXAMPLE 2

[Preparation of Reversible Thermosensitive Recording Medium No. 2]

The procedure for fabricating the reversible thermosensitive recording medium No. 1 in Example 1 was repeated except that the electron beam radiation conducted to the reversible thermosensitive recording layer conducted in Example 1 was changed to such electron beam radiation that was performed two times separately in such a manner that the total electron beam exposure was 30 Mrad, whereby a reversible thermosensitive recording medium No. 2 of the present invention was fabricated.

EXAMPLE 3

[Preparation of Reversible Thermosensitive Recording Medium No. 3]

The procedure for fabricating the reversible thermosensitive recording medium No. 1 in Example 1 was repeated except that the trimethylolpropane triacrylate used as the crosslinking agent was eliminated from the formulation of the coating liquid for the formation of the reversible thermosensitive recording layer in Example 1, and that the electron beam radiation conducted to the reversible thermosensitive recording layer conducted in Example 1 was changed to such electron beam radiation that was performed four times separately in such a manner that the total electron beam exposure was 60 Mrad, whereby a reversible thermosensitive recording medium No. 3 of the present invention was fabricated.

EXAMPLE 4

[Preparation of Reversible Thermosensitive Recording Medium No. 4]

The procedure for fabricating the reversible thermosensitive recording medium No. 1 in Example 1 was repeated except that the vinyl chloride—vinyl acetate copolymer employed in the coating liquid for the formation of the reversible thermosensitive recording layer in Example 1 was replaced by vinyl chloride—vinyl acetate copolymer (Trademark "No. 20-1796", vinyl chloride (80%) and vinyl acetate (20%), average degree of polymerization=3000, made by Kanegafuchi Chemical Industry Co., Ltd.), whereby a reversible thermosensitive recording medium No. 4 of the present invention was fabricated.

EXAMPLE 5

[Preparation of Reversible Thermosensitive Recording Medium No. 5]

The procedure for fabricating the reversible thermosensitive recording medium No. 1 in Example 1 was repeated except that the vinyl chloride—vinyl acetate copolymer employed in the coating liquid for the formation of the reversible thermosensitive recording layer in Example 1 was replaced by vinyl chloride—vinyl acetate copolymer (Trademark "No. 20-1796", vinyl chloride (80%) and vinyl acetate (20%), average degree of polymerization=300, made by Kanegafuchi Chemical Industry Co., Ltd.), and that the electron beam radiation conducted to the reversible thermosensitive recording layer conducted in Example 1 was changed to such electron beam radiation that was performed two times separately in such a manner that the total electron beam exposure was 30 Mrad, whereby a reversible thermosensitive recording medium No. 5 of the present invention was fabricated.

EXAMPLE 6

[Preparation of Reversible Thermosensitive Recording Medium No. 6]

A coating liquid for the formation of a reversible thermosensitive recording layer with the following formulation was coated on the PET side of an aluminum deposited polyester film with a thickness of about 100 μm (Trademark "Metalumy 100TS" made by Toray Industries, Inc.) serving as the support, and dried at 90° C. for 5 minutes, whereby a reversible thermosensitive recording layer with a thickness of about 10 μm was formed on the aluminum deposited polyester film.

| | Parts by Weight |
|---|---|
| Behenic acid (Trademark "B-7644 made by Sigma Chemical Co.) | 8 |
| Stearic acid (Trademark "S-4751" made by Sigma Chemical Co.) | 2 |
| Trimethylolpropane triacrylate (Trademark "TMP3A" made by Osaka Organic Chemical Industry Ltd.) | 2 |

-continued

| | Parts by Weight |
|---|---|
| Vinyl chloride - vinyl acetate copolymer (Trademark "No. 20-1510", vinyl chloride (70%) and vinyl acetate (30%), average degree of polymerization = 500, made by Kanegafuchi Chemical Industry Co., Ltd.) | 37 |
| THF | 130 |
| Toluene | 90 |

The above formed reversible thermosensitive recording layer was subjected to electron beam radiation by use of a commercially available area beam type electron beam radiation apparatus (Trademark "EBC-200AA2" made by Nisshin High Voltage Co., Ltd.) under the conditions that the electron beam exposure was 15 Mrad.

A coating liquid for the formation of a protective layer with the following formulation was coated on the reversible thermosensitive recording layer by a wire bar, dried under the application of heat thereto, and cured by ultraviolet light by use of an 80 W/cm ultraviolet lamp, whereby a protective layer with a thickness of about 2 μm was formed on the reversible thermosensitive recording layer.

| | Parts by Weight |
|---|---|
| 75% solution of butyl acetate of urethaneacrylate type ultraviolet-curing resin (Trademark "Unidic C7-157" made by Dainippon Ink & Chemicals, Incorporated) | 10 |
| IPA | 10 |

Thus, a reversible thermosensitive recording medium No. 6 of the present invention was fabricated.

EXAMPLE 7

[Preparation of Reversible Thermosensitive Recording Medium No. 7]

The procedure for fabricating the reversible thermosensitive recording medium No. 6 in Example 6 was repeated except that the electron beam radiation conducted to the reversible thermosensitive recording layer conducted in Example 6 was changed to such electron beam radiation that was performed two times separately in such a manner that the total electron beam exposure was 30 Mrad, whereby a reversible thermosensitive recording medium No. 7 of the present invention was fabricated.

EXAMPLE 8

[Preparation of Reversible Thermosensitive Recording Medium No. 8]

The procedure for fabricating the reversible thermosensitive recording medium No. 6 in Example 6 was repeated except that the trimethylolpropane triacrylate used as the crosslinking agent was eliminated from the formulation of the coating liquid for the formation of the reversible thermosensitive recording layer in Example 6, and the electron beam radiation conducted to the reversible thermosensitive recording layer conducted in Example 6 was changed to such electron beam radiation that was performed four times separately in such a manner that the total electron beam exposure was 60 Mrad, whereby a reversible thermo-sensitive recording medium No. 8 of the present invention was fabricated.

EXAMPLE 9

[Preparation of Reversible Thermosensitive Recording Medium No. 9]

The procedure for fabricating the reversible thermosensitive recording medium No. 6 in Example 6 was repeated except that the vinyl chloride—vinyl acetate copolymer employed in the coating liquid for the formation of the reversible thermosensitive recording layer in Example 6 was replaced by vinyl chloride—vinyl acetate copolymer (Trademark "No. 20-1507", vinyl chloride (70%) and vinyl acetate (30%), average degree of polymerization=3000, made by Kanegafuchi Chemical Industry Co., Ltd.), whereby a reversible thermosensitive recording medium No. 9 of the present invention was fabricated.

EXAMPLE 10

[Preparation of Reversible Thermosensitive Recording Medium No. 10]

The procedure for fabricating the reversible thermosensitive recording medium No. 6 in Example 6 was repeated except that the vinyl chloride—vinyl acetate copolymer employed in the coating liquid for the formation of the reversible thermosensitive recording layer in Example 6 was replaced by vinyl chloride—vinyl acetate copolymer (Trademark "No. 20-1507", vinyl chloride (70%) and vinyl acetate (30%), average degree of polymerization=3000, made by Kanegafuchi Chemical Industry Co., Ltd.), and that the electron beam radiation conducted to the reversible thermosensitive recording layer conducted in Example 6 was changed to such electron beam radiation that was performed two times separately in such a manner that the total electron beam exposure was 30 Mrad, whereby a reversible thermosensitive recording medium No. 10 of the present invention was fabricated.

EXAMPLE 11

[Preparation of Reversible Thermosensitive Recording Medium No. 11]

The procedure for fabricating the reversible thermosensitive recording medium No. 6 in Example 6 was repeated except that the trimethylolpropane triacrylate used in the coating liquid for the formation of the reversible thermosensitive recording layer in Example 6 was replaced by 6.2 parts by weight of DPCA-30 (Trademark "DPCA-30" made by Nippon Kayaku Co., Ltd.), and that the electron beam radiation conducted to the reversible thermosensitive recording layer conducted in Example 6 was changed to such electron beam radiation that was performed two times separately in such a manner that the total electron beam exposure was 20 Mrad, whereby a reversible thermosensitive recording medium No. 11 of the present invention was fabricated.

EXAMPLE 12

[Preparation of Reversible Thermosensitive Recording Medium No. 12]

The procedure for fabricating the reversible thermosensitive recording medium No. 6 in Example 6 was repeated except that the trimethylolpropane triacrylate used in the coating liquid for the formation of the reversible thermosensitive recording layer in Example 6 was replaced by 3.7 parts by weight of DPHA (Trademark "DPOCA-30" made by Nippon Kayaku Co., Ltd.), and that the electron beam radiation conducted to the reversible thermosensitive recording layer conducted in Example 6 was changed to such electron beam radiation that was performed two times separately in such a manner that the total electron beam exposure was 20 Mrad, whereby a reversible thermo-sensitive recording medium No. 12 of the present invention was fabricated.

EXAMPLE 13

[Preparation of Reversible Thermosensitive Recording Medium No. 13]

The procedure for fabricating the reversible thermosensitive recording medium No. 6 in Example 6 was repeated except that the trimethylolpropane triacrylate used in the coating liquid for the formation of the reversible thermosensitive recording layer in Example 6 was replaced by 12.4 parts by weight of DPCA (Trademark "DPCA-30" made by Nippon Kayaku Co., Ltd.), and that the electron beam radiation conducted to the reversible thermosensitive recording layer conducted in Example 6 was replaced by such ultraviolet light radiation that was performed 9 times separately by use of a commercially available small conveyer type UV radiation apparatus (Trademark "High Cure 250" made by Japan Storage Battery Co., Ltd.) under the conditions that a mercury lamp was used as the light source, the lamp output was set at 3 kW (120 W/cm) and the transportation speed was set at 10 m/min, whereby a reversible thermosensitive recording medium No. 13 of the present invention was fabricated.

EXAMPLE 14

[Preparation of Reversible Thermosensitive Recording Medium No. 14]

The procedure for fabricating the reversible thermosensitive recording medium No. 13 in Example 13 was repeated except that 0.6 parts by weight of 2,4-diethylthioxanthone (Trademark "DETX-S" made by Nippon Kayaku Co., Ltd.) and 0.6 parts by weight of isoamyl p-dimethylaminobenzoate (Trademark "DMBI" made by Nippon Kayaku Co., Ltd.) were added to the coating liquid for the formation of the reversible thermosensitive recording layer in Example 13, whereby a reversible thermosensitive recording medium No. 14 of the present invention was fabricated.

EXAMPLE 15

[Preparation of Reversible Thermosensitive Recording Medium No. 15]

The procedure for fabricating the reversible thermosensitive recording medium No. 10 in Example 10 was repeated except that the thickness of the reversible thermosensitive recording layer in Example 10 was changed to 5 μm, whereby a reversible thermosensitive recording medium No. 15 of the present invention was fabricated.

EXAMPLE 16

[Preparation of Reversible Thermosensitive Recording Medium No. 15]

The procedure for fabricating the reversible thermosensitive recording medium No. 10 in Example 10 was repeated except that the thickness of the reversible thermosensitive recording layer in Example 10 was changed to 15 μm, whereby a reversible thermosensitive recording medium No. 16 of the present invention was fabricated. Comparative Example 1

[Preparation of Comparative Reversible Thermosensitive Recording Medium No. 1]

The procedure for fabricating the reversible thermosensitive recording medium No. 1 in Example 1 was repeated except that the trimethylolpropane triacrylate used as the crosslinking agent was eliminated from the formulation of the coating liquid for the formation of the reversible thermosensitive recording layer in Example 1, and that the electron beam radiation conducted to the reversible thermosensitive recording layer in Example 1 was not conducted, whereby a comparative reversible thermosensitive recording medium No. 1 was fabricated.

Comparative Example 2

[Preparation of Comparative Reversible Thermosensitive Recording Medium No. 2]

The procedure for fabricating the reversible thermosensitive recording medium No. 1 in Example 1 was repeated except that the electron beam radiation conducted to the reversible thermosensitive recording layer in Example 1 was not conducted, whereby a comparative reversible thermosensitive recording medium No. 2 was fabricated.

Comparative Example 3

[Preparation of Comparative Reversible Thermosensitive Recording Medium No. 3]

The procedure for fabricating the reversible thermosensitive recording medium No. 6 in Example 6 was repeated except that the trimethylolpropane triacrylate used as the crosslinking agent was eliminated from the formulation of the coating liquid for the formation of the reversible thermosensitive recording layer in Example 6, and that the electron beam radiation conducted to the reversible thermosensitive recording layer in Example 6 was not conducted, whereby a comparative reversible thermosensitive recording medium No. 3 was fabricated.

Comparative Example 4

[Preparation of Comparative Reversible Thermosensitive Recording Medium No. 4]

The procedure for fabricating the reversible thermosensitive recording medium No. 6 in Example 6 was repeated except that the electron beam radiation conducted to the reversible thermosensitive recording layer in Example 6 was not conducted, whereby a comparative reversible thermosensitive recording medium No. 4 was fabricated.

Comparative Example 5

[Preparation of Comparative Reversible Thermosensitive Recording Medium No. 5]

The procedure for fabricating the reversible thermosensitive recording medium No. 9 in Example 9 was repeated except that the trimethylolpropane triacrylate used as the crosslinking agent was eliminated from the formulation of the coating liquid for the formation of the reversible thermosensitive recording layer in Example 9, and that the electron beam radiation conducted to the reversible thermosensitive recording layer in Example 1 was not conducted, whereby a comparative reversible thermosensitive recording medium No. 5 was fabricated.

Comparative Example 6

[Preparation of Comparative Reversible Thermosensitive Recording Medium No. 6]

The procedure for fabricating the reversible thermosensitive recording medium No. 9 in Example 9 was repeated except that the electron beam radiation conducted to the reversible thermosensitive recording layer in Example 9 was not conducted, whereby a comparative reversible thermosensitive recording medium No. 6 was fabricated.

Comparative Example 7

[Preparation of Comparative Reversible Thermosensitive Recording Medium No. 7]

A coating liquid for the formation of a reversible thermosensitive recording layer with the following formulation was coated on the PET side of an aluminum deposited polyester film with a thickness of about 100 μm (Trademark "Metalumy 100TS" made by Toray Industries, Inc.) which was the same support as that employed in Example 6, dried at 90° C. for 5 minutes, and thermoset, whereby a reversible thermosensitive recording layer with a thickness of about 10 μm was formed on the aluminum deposited polyester film:

| | Parts by Weight |
|---|---|
| Behenic acid (Trademark "B-7644 made by Sigma Chemical Co.) | 8 |
| Stearic acid (Trademark "S-4751" made by Sigma Chemical Co.) | 2 |
| Vinyl chloride - vinyl acetate - vinyl alcohol copolymer (Trademark "S-Lec A" made by Sekisui Chemical Co., Ltd.) | 30 |
| Isocyanate (Trademark "Duranate 24A-100" made by Asahi Chemical Industry Co., Ltd.) | 3 |
| Triethylene diamine (curing promoting agent) | 0.3 |
| Toluene | 30 |
| Tetrahydrofuran | 120 |

Thus, a comparative reversible thermosensitive recording medium No. 7 was fabricated.

In the above, the reversible thermosensitive recording layer was thermoset, so that neither electron beam radiation, nor ultraviolet light radiation was conducted for crosslinking the recording layer.

[Measurement 1 of Thermal Pressure Level Difference and Thermal Pressure Level Difference Change Ratio]

Samples of the reversible thermosensitive recording media No. 1 to No. 16 of the present invention fabricated in Examples 1 to 16, and the comparative reversible thermosensitive recording media No. 1 to No. 16 prepared in Comparative Examples 1 to 7 were subjected to a thermal pressure application test by use of the thermal pressure application apparatus as shown in FIGS. 1(*a*) and 1(*b*) under the conditions that the pressure applied to the recording layer side thereof was 2.5 kg/cm$^2$ the application time was 10 seconds, and the application temperature was 130° C.

By use of the previously mentioned two-dimensional roughness analyzer (Trademark "Surfcorder AY-41" made by Kosaka Laboratory Co., Ltd.), the recorder RA-60E, and Surfcorder Se30K, the average thermal pressure level difference ($\overline{D}$) of each sample of the above-mentioned recording media was read, and the initial thermal pressure level difference ($D_I$) thereof was obtained.

Furthermore, samples of the reversible thermosensitive recording media No. 1 to No. 16 of the present invention fabricated in Examples 1 to 16, and the comparative reversible thermosensitive recording media No. 1 to No. 16 prepared in Comparative Examples 1 to 7 were allowed to stand in a temperature-constant chamber at 50° C. for 24 hours, cooled to room temperature, and then subjected to the same thermal pressure application test as mentioned above, whereby the thermal pressure level difference with time ($D_D$) of each sample was obtained.

The thermal pressure level difference change ratio ($D_C$) of each sample was calculated from the above obtained initial thermal pressure level difference ($D_I$) and thermal pressure level difference with time ($D_D$) thereof. The results are shown in TABLE 1.

FIG. 11(*a*) shows the surface roughness of the reversible thermosensitive recording medium No. 7 prepared in Example 7, which was obtained by the recorder RA-60E when the initial thermal pressure level difference thereof was measured in the above thermal pressure application test.

FIG. 11(*c*) shows the surface roughness of the comparative reversible thermosensitive recording medium No. 3 prepared in Comparative Example 7, which was obtained by the recorder RA-60E when the initial thermal pressure level difference thereof was measured in the above thermal pressure application test.

[Measurement of Gel Percentage and Gel Percentage Change Ratio]

From the samples of the reversible thermosensitive recording media No. 1 to No. 16 of the present invention fabricated in Examples 1 to 16, and the comparative reversible thermosensitive recording media No. 1 to No. 16 prepared in Comparative Examples 1 to 7, the respective reversible thermosensitive recording layers were peeled off the respective supports, so that the initial gel percentages ($G_I$) thereof were obtained.

Samples of the reversible thermosensitive recording layers were prepared in the same manner as mentioned above. Each of these samples was allowed to stand in a temperature-constant chamber at 50° C. for 24 hours, cooled to room temperature, and then subjected to the same thermal pressure application test as mentioned above, whereby the gel percentage with time ($G_D$) of each sample was obtained.

In the above measurements, THF was employed as the solvent.

The gel percentage change ratio ($G_C$) of each sample was calculated from the above obtained initial gel percentage ($G_I$) and gel percentage with time ($G_D$) thereof. The results are shown in TABLE 1.

TABLE 1

| | Thermal Pressure Level Difference & Change Ratio thereof −1 | | | Gel Percentage & Change Ratio thereof | | |
|---|---|---|---|---|---|---|
| | Initial ($D_I$) % | With Time ($D_D$) % | Change Ratio ($D_C$) % | Initial ($G_I$) % | With Time ($G_D$) % | Change Ratio ($G_C$) % |
| Ex. 1 | 18 | 16 | 11.1 | 32.0 | 32.9 | 2.8 |
| Ex. 2 | 10 | 12 | 20 | 71.0 | 71.8 | 1.1 |
| Ex. 3 | 11 | 12 | 9.1 | 68.0 | 69.1 | 1.6 |
| Ex. 4 | 16 | 15 | 6.3 | 48.0 | 49.1 | 2.3 |
| Ex. 5 | 9 | 10 | 11.1 | 88.0 | 88.8 | 1.0 |
| Ex. 6 | 11 | 14 | 27.3 | 54.8 | 57.6 | 5.1 |
| Ex. 7 | 8 | 9 | 12.5 | 82.5 | 84.5 | 2.4 |
| Ex. 8 | 12 | 11 | 8.3 | 72.4 | 74.1 | 2.3 |
| Ex. 9 | 9 | 9 | 0 | 66.1 | 66.3 | 0.3 |
| Ex. 10 | 8 | 8 | 0 | 97.6 | 97.6 | 0 |
| Ex. 11 | 8 | 10 | 25.0 | 91.3 | 92.8 | 1.6 |
| Ex. 12 | 9 | 10 | 11.1 | 83.2 | 83.8 | 0.7 |
| Ex. 13 | 10 | 10 | 0 | 72.9 | 73.8 | 1.2 |
| Ex. 14 | 9 | 8 | 11.1 | 89.8 | 90.8 | 1.1 |
| Ex. 15 | 10 | 9 | 10.0 | 96.6 | 96.9 | 0.3 |
| Ex. 16 | 9 | 8 | 11.1 | 96.5 | 97.0 | 0.5 |
| Comp. Ex. 1 | 95 | 99 | 4.2 | 0 | 0 | — |
| Comp. Ex. 2 | 98 | 100 | 2.0 | 0 | 0 | — |
| Comp. Ex. 3 | 100 | 96 | 4.0 | 0 | 0 | — |
| Comp. Ex. 4 | 94 | 97 | 3.2 | 0 | 0 | — |
| Comp. Ex. 5 | 58 | 51 | 12.1 | 0 | 0 | — |
| Comp. Ex. 6 | 62 | 57 | 8.1 | 0 | 0 | — |
| Comp. Ex. 7 | 30 | 5 | 83.3 | 44.6 | 97.9 | 119.5 |

[Durability Test]

The reversible thermosensitive recording media No. 1 to No. 16 of the present invention fabricated in Examples 1 to 16, and the comparative reversible thermosensitive recording media No. 1 to No. 16 prepared in Comparative Examples 1 to 7 were subjected to a durability test by repeating image formation and erasure under the following conditions:

As the image formation apparatus, a thermal head printing test machine made by Yashiro Denki Co., Ltd. As the thermal head, a 8 dots/mm thermal head made by Ricoh Company, Ltd. was employed, and milky white images were formed under the conditions that the pulse width of 2 msec and the applied voltage was 20.0 V.

Image erasure was performed by use of a hot stamp at an image erasing temperature of 100° C. for the recording media prepared in Examples 1 to 5 and Comparative Examples 1 and 2, and at an image erasing temperature of 70° C. for the recording media prepared in Examples 7 to 16 and Comparative Examples 3 to 7, with the application of a pressure of 1 kg/cm$_2$ for 1.0 sec.

Each of the above-mentioned reversible thermosensitive recording media to a 100-cycle image formation and erasure durability test in which one cycle of image formation and erasure contained the steps of forming a milky white image formation and erasing the formed milky white image.

In the course of this 100-cycle image formation and erasure durability test, the density of the milky white image at the 1st cycle and that at the 100th cycle were measured by Macbeth Reflection Densitometer (RD-914).

The results of this 100-cycle image formation and erasure durability test are shown in TABLE 2.

TABLE 2

| | 100-cycle Image Formation & Erasure Durability Test | |
|---|---|---|
| | Density of Milky White Image at 1st Cycle | Density of Milky White Image at 100th Cycle |
| Ex. 1 | 0.41 | 0.62 |
| Ex. 2 | 0.40 | 0.49 |
| Ex. 3 | 0.38 | 0.48 |
| Ex. 4 | 0.46 | 0.61 |
| Ex. 5 | 0.44 | 0.50 |
| Ex. 6 | 0.27 | 0.58 |
| Ex. 7 | 0.25 | 0.44 |
| Ex. 8 | 0.24 | 0.44 |
| Ex. 9 | 0.32 | 0.57 |
| Ex. 10 | 0.31 | 0.47 |
| Ex. 11 | 0.26 | 0.41 |
| Ex. 12 | 0.25 | 0.42 |
| Ex. 13 | 0.31 | 0.55 |
| Ex. 14 | 0.33 | 0.53 |
| Ex. 15 | 0.46 | 0.64 |
| Ex. 16 | 0.27 | 0.47 |
| Comp. Ex. 1 | 0.39 | 0.99 |
| Comp. Ex. 2 | 0.40 | 1.06 |
| Comp. Ex. 3 | 0.24 | 0.89 |
| Comp. Ex. 4 | 0.26 | 0.96 |
| Comp. Ex. 5 | 0.32 | 0.82 |
| Comp. Ex. 6 | 0.35 | 0.87 |
| Comp. Ex. 7 | 0.25 | 0.40 |

[High Energy Application Test]

The reversible thermosensitive recording media No. 1 to No. 5 fabricated in Examples 1 to 5 and the comparative reversible thermosensitive recording media No. 1 and No. 2 fabricated in Comparative Examples 1 and 2 were subjected to the following energy application tests:

As the image formation apparatus, the thermal head printing test machine as that employed in the above-mentioned durability test was employed, and two image formation tests were conducted.

In the first image formation test, a milky white image was formed in each of the above-mentioned reversible thermosensitive recording media under the conditions that an appropriate energy of 0.4 mJ/dot was applied to the thermal head.

In the second image formation test, the same milky white image as in the first image formation test was formed in each of the above-mentioned reversible thermosensitive recording media under the conditions that a high energy of 3.2 mJ/dot was applied to the thermal head.

The density of each of the milky white images formed in the above-mentioned reversible thermosensitive recording media in these two image formation tests was measured by Macbeth Reflection Densitometer (RD-914). The results are shown in TABLE 3.

TABLE 3

| | High Energy Application Test | |
|---|---|---|
| | Appropriate Energy (0.4 mJ/dot) | High Energy (3.2 mJ/dot) |
| Ex. 1 | 0.40 | 0.59 |
| Ex. 2 | 0.39 | 0.49 |
| Ex. 3 | 0.37 | 0.51 |
| Ex. 4 | 0.45 | 0.62 |
| Ex. 5 | 0.46 | 0.52 |
| Comp. Ex. 1 | 0.40 | 0.89 |
| Comp. Ex. 2 | 0.39 | 0.94 |

[Measurement of Transparent Temperature Range and Transparent Temperature Width]

The transparent temperature range and transparent temperature width of each of the reversible thermosensitive recording media No. 1 to No. 16 of the present invention fabricated in Examples 1 to 16, and the comparative reversible thermosensitive recording media No. 1 to No. 16 prepared in Comparative Examples 1 to 7 were measured as follows:

All of these recording media were in a transparent state.

Each of the recording media was heated in a constant-temperature chamber at 120° C. for 1 minute, and cooled to room temperature, whereby each recording medium was caused to assume a milky white opaque state.

The recording media fabricated in Examples 1 to 5 and the comparative recording media fabricated in Comparative Examples 1 and 2 were heated stepwise with the intervals of 1° C. for 1 minute from 50° C. to 120° C. and then cooled to room temperature.

The recording media fabricated in Examples 6 to 16 and the comparative recording media fabricated in Comparative Examples 3 to 7 were heated stepwise with the intervals of 1° C. for 1 minute from 50° C. to 80° C. and then cooled to room temperature.

The reflection density of each of the above recording media was measured by Macbeth Reflection Densitometer (RD-914). The temperature at which the thus measured reflection density exceeded 0.8 was defined as the transparent temperature, whereby the transparent temperature range and transparent temperature width of each recording medium were measured. The results are shown in TABLE 4.

Apart from the above image formation test, each of the reversible thermosensitive recording media No. 1 to No. 16 of the present invention fabricated in Examples 1 to 16 was allowed to stand in a constant-temperature chamber at 50° C. for 24 hours and was then cooled to room temperature.

The thus obtained samples of the reversible thermosensitive recording media were subjected to the same test as mentioned above, whereby the transparent temperature range and transparent temperature width of each recording medium were measured. The results are shown in TABLE 4.

TABLE 4

| | Initial | | With Time | |
|---|---|---|---|---|
| | Transparent Temperature Range (°C.) | Transparent Temperature Width (°C.) | Transparent Temperature Range (°C.) | Transparent Temperature Width (°C.) |
| Ex. 1 | 80.9–110.5 | 29.6 | 81.2–110.5 | 29.3 |
| Ex. 2 | 81.5–110.7 | 29.2 | 81.4–110.5 | 29.1 |
| Ex. 3 | 78.6–108.1 | 29.5 | 78.9–108.2 | 29.3 |
| Ex. 4 | 75.2–107.5 | 32.3 | 75.6–107.7 | 32.1 |
| Ex. 5 | 75.3–107.2 | 31.9 | 75.5–107.2 | 31.7 |
| Ex. 6 | 61.0–72.4 | 11.4 | 61.9–72.3 | 10.4 |
| Ex. 7 | 61.4–72.3 | 10.9 | 61.4–72.3 | 10.9 |
| Ex. 8 | 61.0–71.7 | 10.7 | 61.2–71.7 | 10.5 |
| Ex. 9 | 59.8–70.5 | 10.7 | 60.0–70.4 | 10.4 |
| Ex. 10 | 60.0–70.2 | 10.2 | 60.0–70.2 | 10.2 |
| Ex. 11 | 63.0–72.4 | 9.4 | 63.2–72.4 | 9.2 |
| Ex. 12 | 62.4–72.2 | 9.8 | 62.6–72.0 | 9.4 |
| Ex. 13 | 63.8–72.3 | 8.5 | 64.2–72.4 | 8.2 |
| Ex. 14 | 63.9–72.1 | 8.2 | 63.9–72.0 | 8.1 |
| Ex. 15 | 60.4–70.5 | 10.1 | 60.3–70.4 | 10.1 |
| Ex. 16 | 60.2–70.4 | 10.2 | 60.2–70.3 | 10.1 |
| Comp. Ex. 1 | 84.9–111.4 | 26.5 | 85.0–111.2 | 26.2 |
| Comp. Ex. 2 | 86.2–110.7 | 24.5 | 86.4–110.5 | 24.1 |
| Comp. Ex. 3 | 63.5–72.7 | 9.2 | 63.7–72.7 | 9.0 |
| Comp. Ex. 4 | 63.9–72.8 | 8.9 | 63.9–72.6 | 8.7 |
| Comp. Ex. 5 | 61.8–72.0 | 10.2 | 62.0–72.1 | 10.1 |
| Comp. Ex. 6 | 62.5–72.4 | 9.9 | 62.7–72.7 | 10.0 |
| Comp. Ex. 7 | 62.9–72.3 | 9.4 | 67.8–72.1 | 4.3 |

Figure 12:
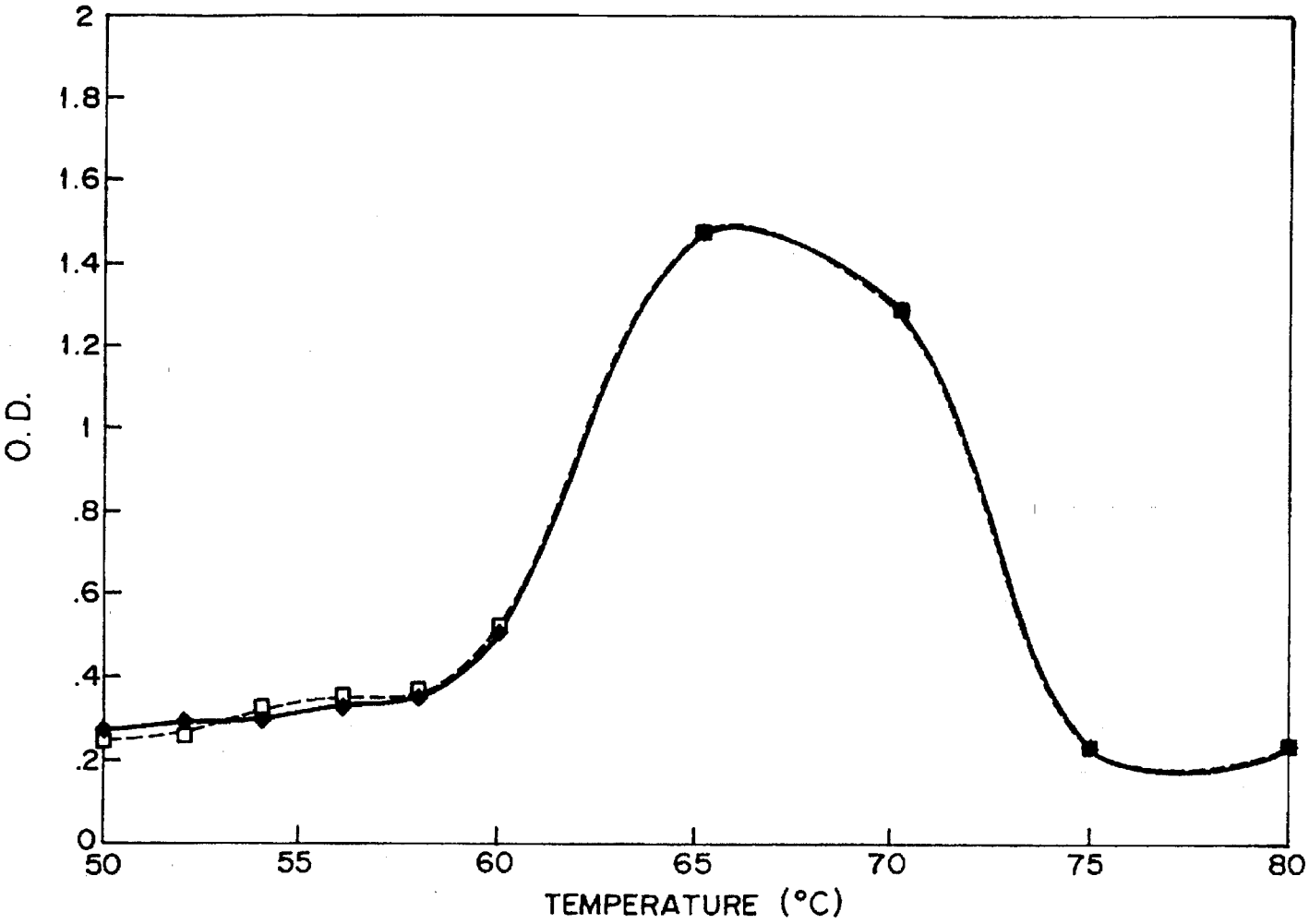
FIG. 12 is a graph showing the relationship between the changes in the density of the images of the reversible thermosensitive recording medium No. 7 fabricated in Example 7 and the temperature thereof.

FIG. 12 is a graph showing the relationship between the changes in the density of the images of the reversible thermosensitive recording medium No. 7 fabricated in Example 7 and the temperature thereof, indicating the transparent temperature range of the recording medium.

In the graph, the curve with ♦ indicates the changes in the image density of the "initial" recording medium No. 7 with the temperature thereof; and the curve with □ indicates the changes in the image density of the "with-time" recording medium No. 7 which was allowed to stand in the 50° C. chamber for 24 hours.

Figure 13:
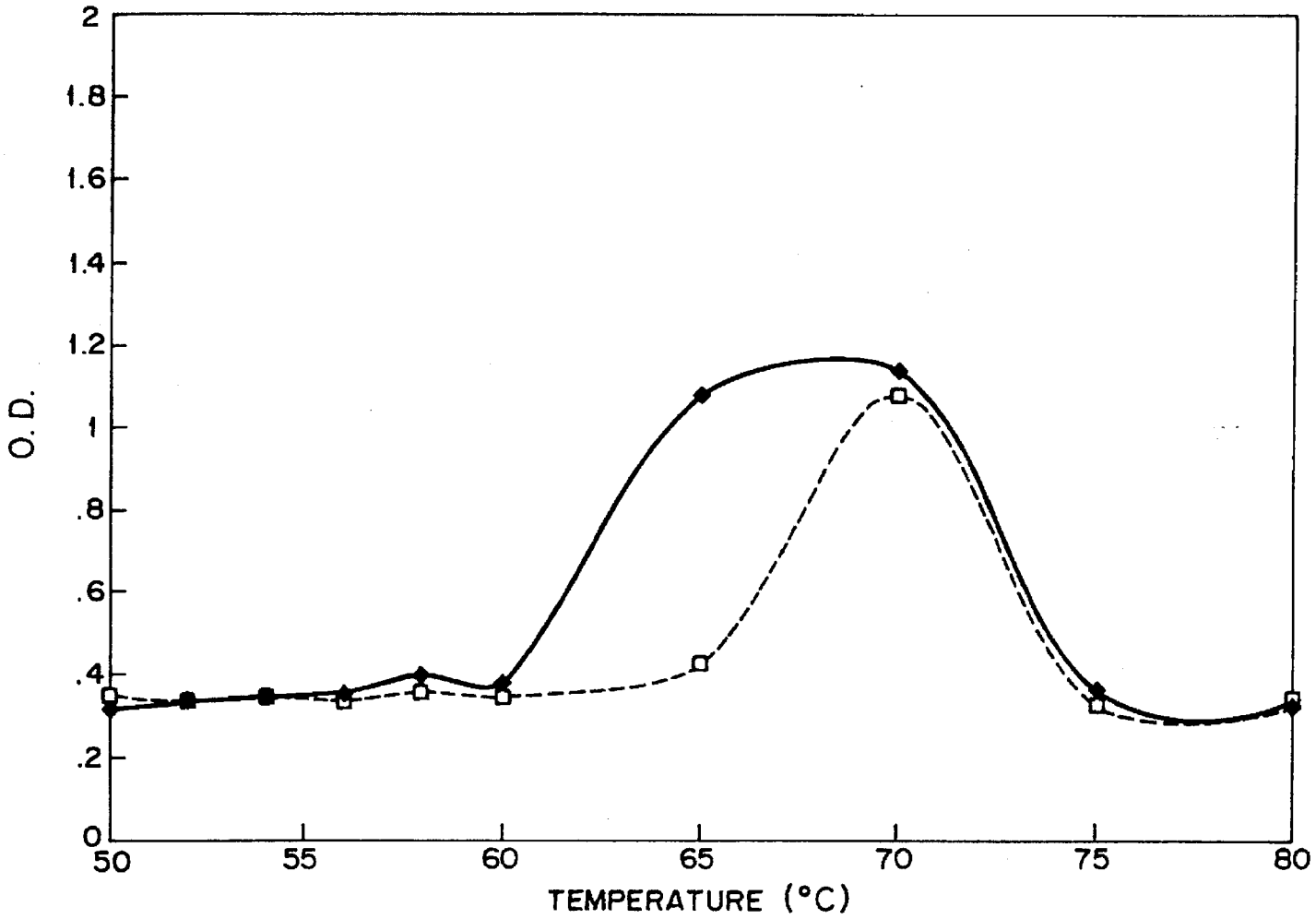
FIG. 13 is a graph showing the relationship between the changes in the density of the images of the comparative reversible thermosensitive recording medium No. 7 fabricated in Comparative Example 7 and the temperature thereof.

FIG. 13 is a graph showing the relationship between the changes in the density of the images of the comparative reversible thermosensitive recording medium No. 7 fabricated in Comparative Example 7 and the temperature thereof, indicating the transparent temperature range of the recording medium.

In the graph, the curve with ♦ indicates the changes in the image density of the "initial" recording medium No. 7 with the temperature thereof; and the curve with □ indicates the changes in the image density of the "with-time" recording medium No. 7 which was allowed to stand in the 50° C. chamber for 24 hours.

[Measurement 2 of Thermal Pressure Level Difference and Thermal Pressure Level Difference Change Ratio]

From the reversible thermosensitive recording medium No. 7 of the present invention fabricated in Example 7, and the comparative reversible thermosensitive recording medium No. 3 prepared in Comparative Example 3 to 7, the respective protective layers were scraped off the respective reversible thermosensitive recording layers, and the respective reversible thermosensitive recording layers were exposed.

The thus prepared samples of the reversible thermosensitive recording medium No. 7 and the comparative reversible thermosensitive recording medium No. 3 were subjected to the same thermal pressure application test as conducted in the previously mentioned Measurement 1 of Thermal Pressure Level Difference and Thermal Pressure Level Difference Change Ratio under the same conditions, whereby the initial thermal pressure level difference ($D_I$") and the thermal pressure level difference with time ($D_D$") of each sample were obtained.

The thermal pressure level difference change ratio ($D_C$") of each sample was calculated from the above obtained initial thermal pressure level difference ($D_I$") and thermal pressure level difference with time ($D_D$") thereof. The results are shown in TABLE 5.

TABLE 5

| | Thermal Pressure Level Difference & Change Ratio thereof –2 | | |
|---|---|---|---|
| | Initial ($D_I$) % | With Time ($D_D$) % | Change Ratio ($D_C$) % |
| Ex. 7 | 8 | 7 | 12.5 |
| Comp. Ex. 3 | 96 | 92 | 4.2 |

FIG. 11(*b*) shows the surface roughness of the above sample of the reversible thermosensitive recording medium No. 7, which was obtained by the recorder RA-60E when the initial thermal pressure level difference thereof was measured in the above thermal pressure application test. FIG. 11(*d*) shows the surface roughness of the above sample of the comparative reversible thermosensitive recording medium No. 3, which was obtained by the recorder RA-60E when the initial thermal pressure level difference thereof was measured in the above thermal pressure application test.

The reversible thermosensitive recording medium according to the present comprises the reversible thermosensitive recording layer or display portion having a thermal pressure level difference of 40% or less, and a thermal pressure level difference change ratio of 70% or less, so that milky white images formed therein do not deteriorate even when the image formation and erasure is repeated by use of a thermal head or the like. Thus the repeated use durability of the recording medium is significantly improved.

Furthermore, even when image printing is performed on the reversible thermosensitive recording medium of the present invention with the application of high energy thereto, for instance, by a printer for thermal destructive type recording media, there is not much difference between the image density thus obtained and the image density obtained by the application of an appropriate amount of energy.

Cracks and printing marks are not formed on the surface of the reversible thermosensitive recording layer or display portion, and high contrast can be maintained, even when image formation therein is repeated by use of a thermal head or the like.

Furthermore, the transparent temperature range and width can also be maintained stably even when image formation is repeated.

The above-mentioned advantageous effects can also be intensified by crosslinking the reversible thermosensitive recording layer in such a manner that the resin in the recording layer is caused to have a gel percentage change ratio of 110% or less and a gel percentage ratio is 30% or more.

What is claimed is:

1. In a reversible thermosensitive recording medium comprising a support and a reversible thermosensitive recording layer whose transparency or color reversibly changes by the application of heat thereto formed on said support, the improvement wherein said reversible thermosensitive recording layer has a thermal pressure level difference of 40% or less, and a thermal pressure level difference change ratio of 70% or less.

2. The reversible thermosensitive recording medium as claimed in claim 1, further comprising a protective layer which is situated above said reversible thermosensitive recording layer.

3. The reversible thermosensitive recording medium as claimed in claim 2, wherein said reversible thermosensitive recording layer comprises a resin which is crosslinked.

4. The reversible thermosensitive recording medium as claimed in claim 3, wherein said resin comprises at least one resin component selected from the group consisting of polyvinyl chloride, chlorinated polyvinyl chloride, polyvinylidene chloride, saturated polyester, polyethylene, polypropylene, polystyrene, polymethacrylate, polyamide, polyvinyl pyrrolidone, natural rubber, polyacrolein, and polycarbonate; or said resin is a copolymer comprising any of said resin components.

5. The reversible thermosensitive recording medium as claimed in claim 4, wherein said resin is crosslinked by use of a crosslinking agent.

6. The reversible thermosensitive recording medium as claimed in claim 5, wherein said resin is crosslinked by electron beam or ultraviolet light radiation.

7. The reversible thermosensitive recording medium as claimed in claim 4, wherein said resin is crosslinked by electron beam or ultraviolet light radiation.

8. The reversible thermosensitive recording medium as claimed in claim 3, wherein said resin is crosslinked by use of a crosslinking agent.

9. The reversible thermosensitive recording medium as claimed in claim 8, wherein said resin is crosslinked by electron beam or ultraviolet light radiation.

10. The reversible thermosensitive recording medium as claimed in claim 3, wherein said resin is crosslinked by electron beam or ultraviolet light radiation.

11. The reversible thermosensitive recording medium as claimed in claim 1, wherein said reversible thermosensitive recording layer comprises a resin which is crosslinked.

12. The reversible thermosensitive recording medium as claimed in claim 11, wherein said resin comprises at least one resin component selected from the group consisting of polyvinyl chloride, chlorinated polyvinyl chloride, polyvinylidene chloride, saturated polyester, polyethylene, polypropylene, polystyrene, polymethacrylate, polyamide, polyvinyl pyrrolidone, natural rubber, polyacrolein, and polycarbonate; or said resin is a copolymer comprising any of said resin components.

13. The reversible thermosensitive recording medium as claimed in claim 11, wherein said resin is crosslinked by use of a crosslinking agent.

14. The reversible thermosensitive recording medium as claimed in claim 13, wherein said resin is crosslinked by electron beam or ultraviolet light radiation.

15. The reversible thermosensitive recording medium as claimed in claim 12, wherein said resin is crosslinked by use of a crosslinking agent.

16. The reversible thermosensitive recording medium as claimed in claim 15, wherein said resin is crosslinked by electron beam or ultraviolet light radiation.

17. The reversible thermosensitive recording medium as claimed in claim 12, wherein said resin is crosslinked by electron beam or ultraviolet light radiation.

18. The reversible thermosensitive recording medium as claimed in claim 11, wherein said resin is crosslinked by electron beam or ultraviolet light radiation.

19. The reversible thermosensitive recording medium as claimed in claim 1, wherein said reversible thermosensitive recording layer comprises a) a cross-linked matrix resin and b) either a low molecular weight material or a color former/color developer mixture.

20. In a reversible thermosensitive recording medium comprising a reversible thermosensitive recording layer whose transparency or color reversibly changes by the application of heat thereto, said reversible thermosensitive recording layer constituting an image display portion and comprising a resin therein, the improvement wherein said resin is crosslinked and has a gel percentage change ratio of 110% or less.

21. The reversible thermosensitive recording medium as claimed in claim 20, wherein said resin has a gel percentage ratio is 30% or more.

22. The reversible thermosensitive recording medium as claimed in claim 21, wherein said resin is crosslinked by subjecting said resin to electron beam or ultraviolet light radiation.

23. The reversible thermosensitive recording medium as claimed in claim 20, further comprising a protective layer which is situated above said reversible thermosensitive recording layer.

24. The reversible thermosensitive recording medium as claimed in claim 23, wherein said resin has a gel percentage ratio is 30% or more.

25. The reversible thermosensitive recording medium as claimed in claim 24, wherein said resin is crosslinked by subjecting said resin to electron beam or ultraviolet light radiation.

26. The reversible thermosensitive recording medium as claimed in claim 23, wherein said resin is crosslinked by subjecting said resin to electron beam or ultraviolet light radiation.

27. The reversible thermosensitive recording medium as claimed in claim 20, wherein said resin is crosslinked by use of a crosslinking agent.

28. The reversible thermosensitive recording medium as claimed in claim 27, wherein said resin comprises at least one resin component selected from the group consisting of polyvinyl chloride, chlorinated polyvinyl chloride, polyvinylidene chloride, saturated polyester, polyethylene, polypropylene, polystyrene, polymethacrylate, polyamide, polyvinyl pyrrolidone, natural rubber, polyacrolein, and polycarbonate; or said resin is a copolymer comprising any of said resin components.

29. The reversible thermosensitive recording medium as claimed in claim 27, wherein said resin is crosslinked by subjecting said resin to electron beam or ultraviolet light radiation.

30. The reversible thermosensitive recording medium as claimed in claim 20, wherein said resin is crosslinked by subjecting said resin to electron beam or ultraviolet light radiation.

31. The reversible thermosensitive recording medium as claimed in claim 20, wherein said reversible thermosensitive recording layer comprises a) a cross-linked matrix resin and b) either a low molecular weight material or a color former/color developer mixture.

32. A method of producing a reversible thermosensitive recording medium as claimed in claim 1, wherein said reversible thermosensitive recording layer comprises a resin, comprising the step of crosslinking said resin by subjecting said resin to electron beam or ultraviolet light radiation a plurality of times.

33. A method of producing a reversible thermosensitive recording medium as claimed in claim 1, wherein said reversible thermosensitive recording layer comprises a resin and an organic mow-molecular-weight material, comprising the steps of:

heating said resin to a temperature at which at least part of said organic low-molecular-weight material is melted, and crosslinking said resin.

34. The method of producing a reversible thermosensitive recording medium as claimed in claim 33, wherein said crosslinking is performed by subjecting said resin to electron beam or ultraviolet light radiation.

* * * * *

UNITED STATES PATENT AND TRADEMARK OFFICE

CERTIFICATE OF CORRECTION

PATENT NO. : 5,627,126

DATED : MAY 6, 1997

INVENTOR(S) : TETSUYA AMANO ET AL

It is certified that error appears in the above-identified patent and that said Letters Patent is hereby corrected as shown below:

Column 3, line 36, "will readily" should read --will be readily--.

Column 8, line 24, "toughened" should read --roughened--.

Column 10, line 12, "protective," should read --protective--.

Column 22, line 3, "compounds can be used alone or in combination. These" should read --These compounds can be used alone or in combination.--;
line 49, "α-phosphonoplamitic" should read --α-phosphonopalmitic--.

Column 25, line 61, "s-position" should read --α-position--.

Column 26, line 37, "methacrlate" should read --methacrylate--.

Column 29, line 48, "photopoymerizable" should read --photopolymerizable--.

Column 36, line 7, "aa" should read --a--.

Column 38, line 54, "However, the these" should read --However, these--.

Column 54, line 22, "is" should read --of--;
line 33, "is" should read --of--.

UNITED STATES PATENT AND TRADEMARK OFFICE

CERTIFICATE OF CORRECTION

PATENT NO. : 5,627,126

DATED : MAY 6, 1997

INVENTOR(S) : TETSUYA AMANO ET AL

It is certified that error appears in the above-identified patent and that said Letters Patent is hereby corrected as shown below:

Column 55, line 8, "mow-" should read --low- --.

Signed and Sealed this

Twenty-first Day of July, 1998

Bruce Lehman

*Attest:*

BRUCE LEHMAN

*Attesting Officer*

*Commissioner of Patents and Trademarks*